US006011518A

United States Patent [19]

Yamagishi et al.

[11] Patent Number: 6,011,518

[45] Date of Patent: Jan. 4, 2000

[54] VEHICLE ANTENNA

[75] Inventors: Hiroshi Yamagishi; Masahiro Tokunaga; Yozo Nishiura, all of Nagoya, Japan

[73] Assignees: Harness System Technologies Research, Ltd., Nagoya; Sumitomo Wiring Systems, Ltd., Mie; Sumitomo Electric Industries, Ltd., Osaka, all of Japan

[21] Appl. No.: 08/900,333

[22] Filed: Jul. 25, 1997

[30] Foreign Application Priority Data

| | | | |
|---|---|---|---|
| Jul. 26, 1996 | [JP] | Japan | 8-197935 |
| Sep. 3, 1996 | [JP] | Japan | 8-233220 |
| Dec. 4, 1996 | [JP] | Japan | 8-324253 |
| May 23, 1997 | [JP] | Japan | 9-133496 |

[51] Int. Cl.[7] ..... H01Q 1/32; H01Q 3/02

[52] U.S. Cl. ..... 343/713; 343/711; 343/700 MS

[58] Field of Search ..... 343/711, 713, 343/700 MS; 359/838, 601–604

[56] References Cited

U.S. PATENT DOCUMENTS

| | | | |
|---|---|---|---|
| 4,835,540 | 5/1989 | Haruyama et al. | 343/700 MS |
| 5,455,716 | 10/1995 | Suman et al. | 359/838 |
| 5,504,478 | 4/1996 | Knapp | 340/825.69 |
| 5,790,973 | 8/1998 | Blaker et al. | 701/123 |
| 5,877,897 | 3/1999 | Schofield et al. | 359/604 |

*Primary Examiner*—Don Wong
*Assistant Examiner*—Jennifer H Malos
*Attorney, Agent, or Firm*—Oliff & Berridge, PLC

[57] ABSTRACT

In the vehicle antenna, a GPS antenna, a radio wave beacon antenna for VICS/automatic rate, and an optical beacon antenna are incorporated into between the mirror of a room mirror and a cover and they are united together into an integrated body. The vehicle antenna is structured such that it is allowed to transmit and receive signals with respect to a GPS, a VICS/automatic rate beacon, and an optical beacon through the windshield of a vehicle. This structure eliminates the need to install the respective antennas of the vehicle antenna onto a vehicle body and an instrumental panel, thereby being able to improve the appearance of the interior of the vehicle. Also, since the vehicle antenna is incorporated in the room mirror, the vehicle antenna is not visible directly to the eyes of a driver and is kept from reflecting its shade into the windshield to thereby prevent interference with the driving operation of the driver.

6 Claims, 16 Drawing Sheets

VEHICLE ANTENNA

BACKGROUND OF THE INVENTION

1. Field of the Invention

The present invention relates to a directional electric device, in particular, an antenna which is carried on board a vehicle or the like.

2. Description of the Related Art

In recent years, for example, with the spread of introduction of car information equipment such as the introduction of a two-way information terminal into a car navigation device, introduction of an automatic rate collection system, and the like, the number of car on-board antennas used shows a tendency to increase.

Conventionally, these car on-board antennas have been carried on board the inside and outside of a car body according to their individual systems. For example, a GPS (Global Positioning System) antenna for car navigation is in most cases installed on the roof of the car body and is connected by a coaxial cable to the main body of a car navigation device installed in the inside of the car. Also, an antenna for a radio wave beacon or an antenna for an optical beacon, which is used in a VICS (Vehicle Information and Communication System), is installed on an instrumental panel and is connected by a cable to the main body of the car navigation device. Further, an antenna for an automatic rate collection system is installed on the instrumental panel and is connected by a coaxial cable to the main body of the car navigation device.

However, in the above-mentioned conventional method, there are found several problems as follows:

(1) Since the antennas are installed on the car body or instrumental panel, they are not fit to be seen and, sometimes, can make a driver uncomfortable while driving the car.

For example, the antenna installed on the instrumental panel casts its shadow onto the windshield of the car, which provides an obstacle to driving.

(2) Cables for connecting the respective antennas to the receiving part of the car navigation device and connectors used for such cables are necessary in number corresponding to the number of the antennas used, which increases the cost of the car navigation device.

Further, installation of these antennas is an option and is carried after completion of assembling of the car, which also raises the following problems in the wiring operation:

(3) Because wiring for the antennas is arranged on the instrumental panel or along the upholstery of the car, such wiring is not fit to be seen.

(4) When arranging the antenna wiring within the upholstery (for example, within the instrumental panel) in order to improve the above-mentioned poor wiring, the upholstery. must be removed once and the operation to remove the upholstery takes time and labor.

In addition, conventionally, as a receiver unit for use in a navigation system or the like carried on board a vehicle such as a car or the like, there is known a receiver unit 101 having such a structure as shown in FIGS. 21 and 22. The illustrated receiver unit 101 includes a metal case 102 and antennas 103, 104 each of a flat-surface type, that is, in the receiver unit 101, normally, in order to prevent the deterioration of the performance of the antennas, the antennas 103 and 104 are disposed on the upper surface portion of the metal case 102.

Besides, between a substrate part 105, which is disposed on the upper portion of the receiver unit 101 and also on which circuitry is formed, and the upper surface of the case 102, there are packaged or mounted other necessary parts 106. Further, when there is a position restriction that a given clearance must be provided between the antennas 103, 104 and the substrate part 105, the antennas 103 and 104 are respectively mounted on their corresponding given sub-substrate 108 and 109 and are also connected to their corresponding connecting connectors 112 respectively serving as antenna connecting parts on the substrate 105 side by use of their respective cables 110 and connectors 111.

Further, reference characters 114 and 115 respectively designate upper portion cover bodies which are mounted on the upper surface portion of the case 102 in such a manner that they respectively cover their corresponding antennas 103 and 104, while the upper portion cover bodies 114 and 115 respectively include a pair of engaging projection pieces 114*a* and 115*a* which are provided in the lower end edge portions thereof. On the other hand, the case 102 includes two openings 116 and 117 which are respectively formed in the upper surface of the case 102, while the two openings 116 and 117 respectively include securing portions 118 and 119 respectively formed in the peripheral edge portions thereof. Thus, the securing projection pieces 114*a* and 115*a* of the two upper portion cover bodies 114 and 115 are respectively inserted into and secured to securing holes respectively formed in the securing portions 118 and 119, whereby the upper portion cover bodies 114 and 115 can be fixed and held in such a manner that they are prevented against removal. Further, due to such fixation of the upper portion cover bodies 114 and 115, the antennas 103 and 104 can be positioned and fixed respectively.

However, in the above-mentioned conventional method for connecting the antennas 103 and 104 to the substrate part 105, there are required the sub-substrates 108, 109, cables 110, and connectors 111 separately, that is, the number of parts necessary is large, which results in the high cost of the antenna device.

In addition, in the above conventional method, when mounting the antennas 103 and 104 onto the substrates 108 and 109, as shown in FIG. 23, there is employed a technique in which they are bonded using a double-side adhesive tape 121. However, in such bonding operation, there are required an operation to remove a protection film from the double-side adhesive tape 121 and an operation to bond the double-side adhesive tape 121 to the antennas 103 and 104 as well as to the sub-substrates 108 and 109. For this reason, the bonding operation is troublesome and is poor in efficiency. Further, when a foreign body is present between the double-side tape 121 and antennas 103, 104 and/or between the double-side tape 121 and sub-substrates 108, 109, there is a fear that the double-side tape 121 can be removed due to vibration or the like. In the bonding operation, the double-side tape 121 must be bonded with the directivities of the antennas 103 and 104 taken into account.

SUMMARY OF THE INVENTION

In view of the above-mentioned problems found in the conventional car antennas, it is an object of the invention to provide a car antenna which is installed in such a manner that it is fit to be seen and does not make a driver uncomfortable while driving a car. Also, it is another object of the invention to provide a car antenna which can reduce the number of cables and the number of connectors used for the cables. Further, it is still another object of the invention to provide a car antenna which not only allows antenna wiring to be arranged in such a manner it is fit to be seen but also permits the antenna wiring to be arranged easily within the upholstery of a car.

In attaining the above objects, according to the invention, there is employed a structure in which an antenna is built in a mirror of a car such as, for example a rearview mirror to thereby make the antenna invisible. Thanks to this structure, there is eliminated the possibility that the antenna is not fit to be seen and can make a driver uncomfortable while driving a car.

In addition, it is an object of the invention to provide an improved antenna device for connection with an antenna connecting portion provided in a substrate part forming a communication device unit, in which the number of parts can be reduced to thereby reduce the cost thereof as well as the efficiency of the mounting operation thereof can be improved.

In attaining the above object, according to the invention, there is provided an antenna device for connection with an antenna connecting portion provided in a substrate part forming a communication device unit, in which the antenna device has an antenna main body portion of a flat-surface type to be disposed on the upper surface portion of a case forming the communication device unit, and a signal transmission support member provided integrally on and projected downwardly from the lower surface side of the antenna main body portion; the antenna main body portion includes a high dielectric layer portion formed of dielectric material, and a sensitive conductor layer portion provided on the upper surface side of the high dielectric layer portion; the signal transmission support member includes a downwardly projecting support member main body portion formed of the same material as the high dielectric layer portion and provided integrally with the high dielectric layer portion, and an inner conductor so disposed as to extend within the support member main body portion along the axial direction thereof and connected to the sensitive conductor layer portion; and, the antenna connecting portion includes an inner conductor connecting portion with which the inner conductor can be connected when the signal transmission support member lower end portion is connected.

BRIEF DESCRIPTION OF THE DRAWING FIGURES

DETAILED DESCRIPTION OF THE PREFERRED EMBODIMENTS

Now, description will be given below of the embodiments of a car antenna according to the invention with reference to the accompanying drawings.

Figure 1:
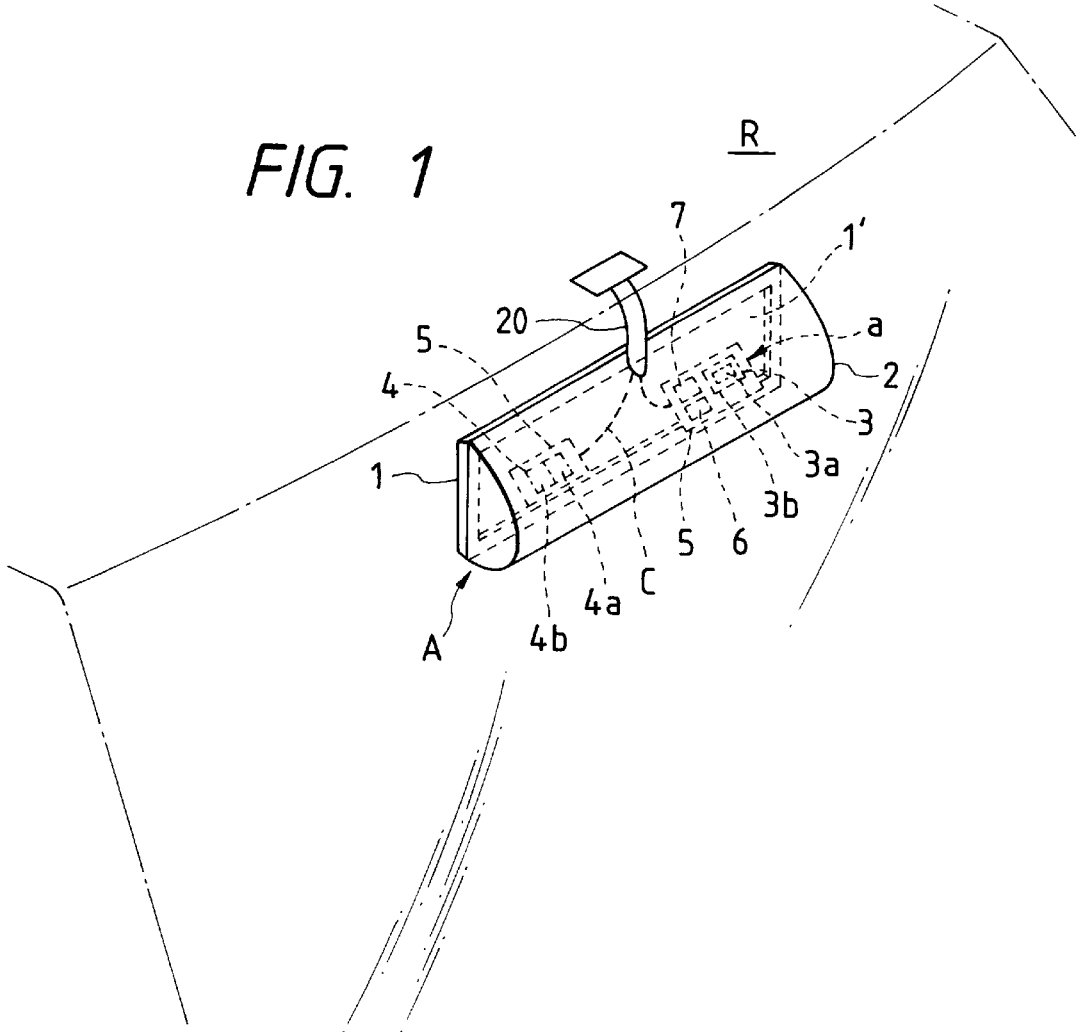
FIG. 1 is a perspective view of a first embodiment of a car antenna according to the invention.

At first, in FIG. 1, there is shown a first embodiment of a car antenna A according to the invention.

In the car antenna A of this type, as shown in FIG. 1, an antenna a is built in between the mirror 1' of, for example, a rearview mirror 1 and a transparent cover 2 and is then united together into an integral body.

The built-in antenna a is composed of an integrated antenna part 3 and an optical beacon head part 4.

The integrated antenna part 3, which is an integrated body of radio wave antennas, includes a GPS antenna 3*a*, a radio wave beacon antenna 3*b* for VICS/automatic rate, a wave combining device 6, and an amplifier 7.

Figure 2:
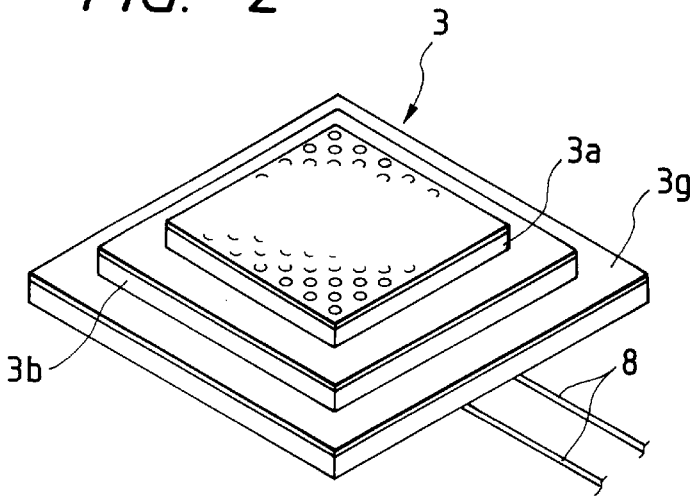
FIG. 2 is a perspective view of the main portions of the first embodiment.

Also, the integrated antenna part 3 of this type employs a microstrip antenna. That is, the microstrip antenna is an antenna formed by removing, that is, by edging a desired portion of metal foil from a dielectric substrate with the metal foil attached thereto. For example, in the integrated antenna part 3, as shown in FIG. 2, there is employed a stud type structure in which three substrates, which are respectively formed as the GPS antenna 3*a*, radio wave beacon antenna 3*b* and ground plane 3*g*, are piled on top of one another and feeder cables 8 are attached to the antenna part 3. That is, due to employment of such stud type structure, the integrated antenna part 3 can be made compact.

Figure 3:
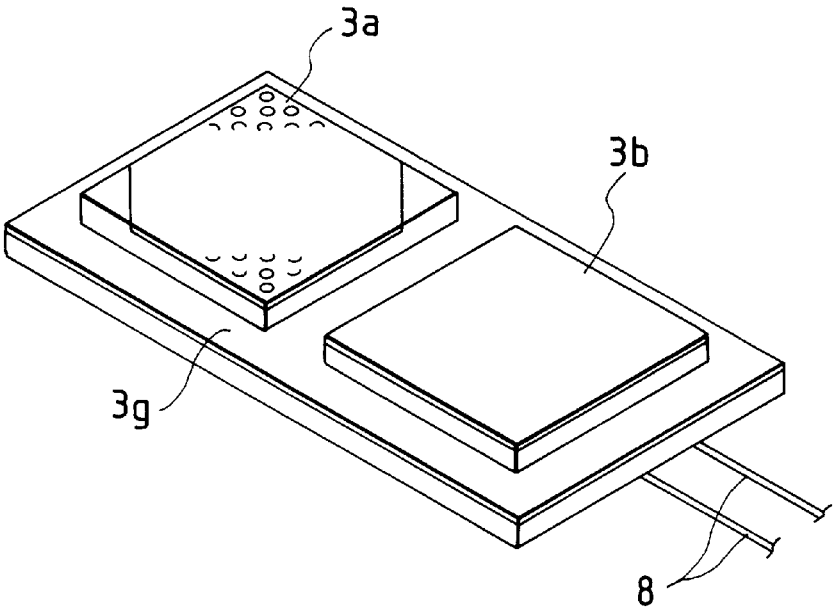
FIG. 3 is a perspective view of a modification of the main portions of the first embodiment shown in FIG. 2.

Also, besides the stud type structure, the integrated antenna part 3 may also employ a (two-layer) parallel arrangement type structure in which, as shown in FIG. 3, the GPS antenna 3*a* and radio wave beacon antenna 3*b* are arranged in parallel to each other on the ground plane 3*g*.

On the other hand, the wave combining device 6 can be produced, for example, in such a manner that there is provided a mounting substrate 5 for mounting the integrated antenna part 3 thereon and a microstrip line is formed on the mounting substrate 5.

Figure 4:
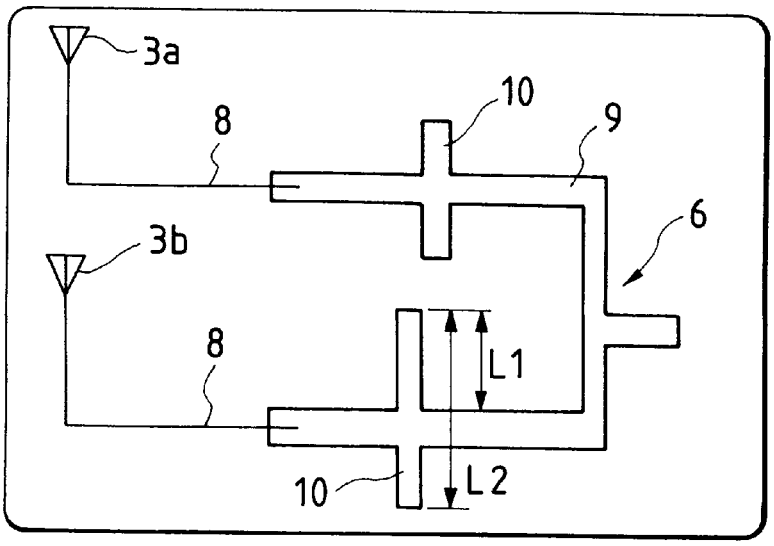
FIG. 4 is a partially perspective view of the main portions of the first embodiment.

For example, on the mounting substrate 5, there is provided a transmission line 9 which is used to connect the GPS antenna 3*a* with the feeder cables 8 of the radio wave beacon antenna 3*b*, and, in the transmission line 9, there are formed stubs 10 as shown in FIG. 4. In this case, by selecting the positions and lengths (such as L1, L2, and the like) of the stubs 10, the resonance frequency and impedance of the transmission line 9 are adjusted. Further, the resonance frequency of the transmission line 9 with respect to one set of antennas 3*a*, 3*b* is approximated infinitely to the resonance frequency of the transmission line 9 with respect to the other set of antennas 3*a*, 3*b*, thereby being able to eliminate interference by the other set of antennas 3*a*, 3*b*.

With use of the wave combining device 6 structured in the above-mentioned pattern, the signals of a plurality of built-in antennas can be combined together without using circuit components such as a coil, a capacitor and the like. This makes it possible not only to reduce the size and cost of the integrated antenna part 3 but also to integrate cables C, each of which has been conventionally necessary for each of built-in antennas a, to thereby reduce the number of the cables C.

By the way, if power and signals for an optical beacon head to be discussed later are superimposed on the wave combining device 6, then the above-mentioned integration effect can be increased further. The output of the wave combining device 6 is connected with the amplifier 7 which is provided on the mounting substrate 5.

The amplifier 7 is a booster circuit which is used to amplify the output of the wave combining device 6 by approx. 20 db. Due to the fact that the wave combining device 6 and amplifier 7 are provided on a single substrate, it is possible to reduce the number of cables necessary for connection between the built-in antenna a, wave combining device 6 and amplifier 7 as well as the number of connectors for connecting the cables.

Additionally, the optical beacon head part 4 includes a signal receiving photodiode 4*a* and a signal transmission LED 4*b*, and achieves two-way communication with an optical beacon which is disposed above a road.

That is, if the signal receiving photodiode 4*a* receives an optical signal transmitted from the optical beacon positioned above a road and transmits the optical signal to the main body of the car navigation device, then the car navigation device main body decodes the optical signal and displays the meaning of the optical signal on a display device. Further, in response to this, the car navigation device main body encodes a vehicle ID number and the like and allows the signal transmission LED 4*b* to transmit the coded signal to the optical beacon.

The present embodiment is structured in the above-mentioned manner and, when the car navigation device is installed in the car, this type of car antenna A is mounted on the roof R of the car instead of the conventional rearview mirror 1. After mounting on the roof R, the car antenna A is connected with the car navigation device main body through the cable C. In this state, the built-in antenna a is disposed opposed to the windshield of the car and achieves two-way communication with the GPS as well as the radio wave beacon and optical beacon for the VICS/automatic rate through the windshield.

The present structure eliminates the need to mount the antenna on the car body and instrumental panel, thereby being able to improve the appearance of the interior of the car. In addition, the installation of the built-in antenna a in the rearview mirror 1 prevents the antenna from reflecting its shadow into the windshield, thereby being able to eliminate the possibility that the shadow of the antenna can make a driver uncomfortable while driving a car.

Further, since the wave combining device 6 and amplifier 7 can be built into the rearview mirror 1 together with the built-in antenna a, not only the number of cables necessary for connection thereof with the car navigation device main body but also the number of connectors necessary for connection of the cables can be reduced. This makes it possible not only to reduce the costs of the parts of the present antenna but also to simplify an operation to mount the present antenna.

Figure 5:
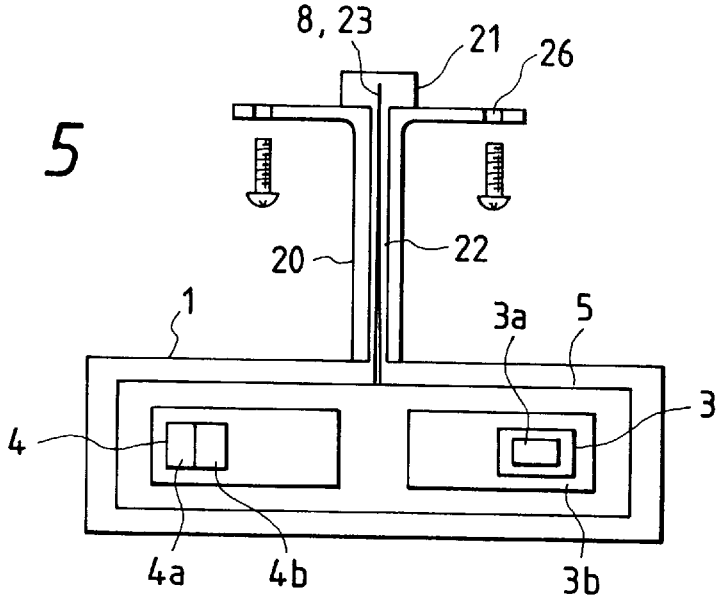
FIG. 5 is a typical view of a second embodiment of a car antenna according to the invention.
Figure 6:
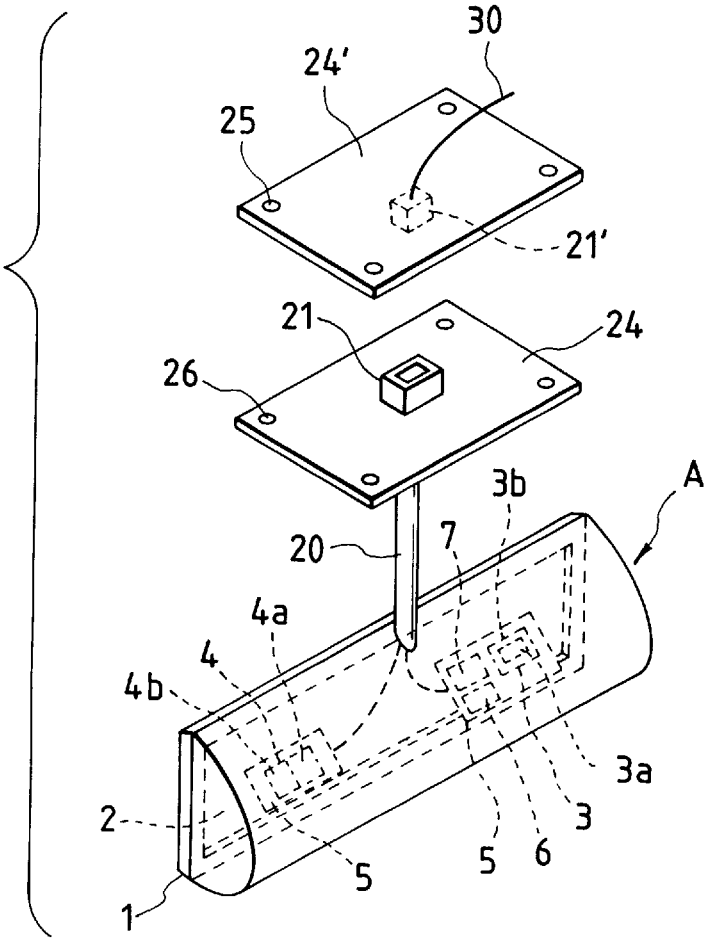
FIG. 6 is an exploded perspective view of the second embodiment.

Next, as a second embodiment of the invention, in FIGS. 5 and 6, there is shown an embodiment in which a connector 21 is provided in the car antenna A according to the first embodiment of the invention.

That is, in the second embodiment, the connector 21 is disposed on the end portion of a mounting shaft 20 which is a support member for supporting the car antenna A, there is provided on the roof R a connector 21' which can be fitted with the connector 21, so that the two connectors 21 and 21' can be connected with each other. According to this structure, there is formed an insertion hole 22 in the mounting shaft 20 serving as the support member of the car antenna A.

The feeder cable 8 from the built-in antenna a is inserted into the insertion hole 22. That is, since the feeder cable 8 is inserted into the insertion hole 22 and is thereby made invisible, the appearance of the interior of the car is improved. Also, because there is no possibility of the feeder cable 8 reflecting its shadow onto the windshield of the car, there is eliminated the possibility that a driver can be made uncomfortable due to such reflected shadow while driving the car.

By the way, although the cable C may be used as the feeder cable 8, in the present embodiment, a microstrip line 23 is used as the feeder cable 8. In the microstrip line 23, one end thereof is disposed on the mounting substrate 5 so that it can be connected with the built-in antenna a. Besides, the other end of the microstrip line 23 is used as the terminal of the male connector 21. That is, by using the edge of the microstrip line as the male terminal of the male connector, the cost of the connector can be reduced.

The female connector 21' to be connected with the male connector 21 is mounted into a wiring opening (not shown) formed in the roof R (which will be discussed later). The female connector 21' is composed of a female contact part and a roof side fixed metal member 24'. The fixed metal member 24' is formed in a square shape and includes four screw hole taps 25 respectively formed in the four corners thereof.

On the other hand, the mirror-side connector 21 includes a mirror-side fixed metal member 24. The mirror-side fixed metal member 24 is formed in the same square shape as the roof-side fixed metal member 24' and includes, in its four corners, four mounting holes 26 which are respectively formed slightly larger in size than the holes of the roof-side fixed metal member 24' and can be fitted with them.

Thanks to the above structure, if the mirror-side male connector 21 is fitted with the roof-side female connector 21' and they are then screwed together, then they can be fixed simply. In this operation, a tolerance between them can be absorbed by a difference between the diameter of the mounting hole 26 of the antenna-side fixed metal member 24 and the diameter of the screw hole 25 of the roof-side fixed metal member 24'.

By the way, in the present embodiment, the connectors 21 and 21' are screwed together by means of their fixed metal members. However, this is not limitative but, for example, as shown in FIGS. 7A and 7B, there can be provided lock mechanisms in the connectors 21 and 21', so that the two connectors 21 and 21' can be fixed together by means of such lock mechanisms.

Figure 7A:
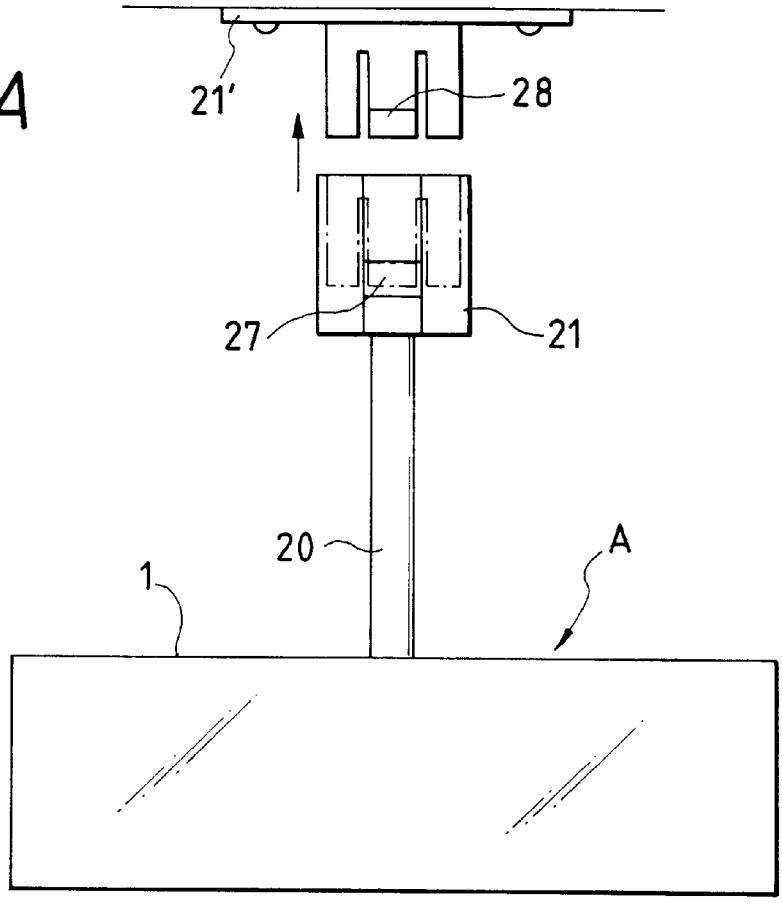
FIG. 7A is an explanatory view of the operation of a modification of the second embodiment; and, FIG. 7B is also an explanatory view of the operation of the above modification of the second embodiment.
Figure 7B:
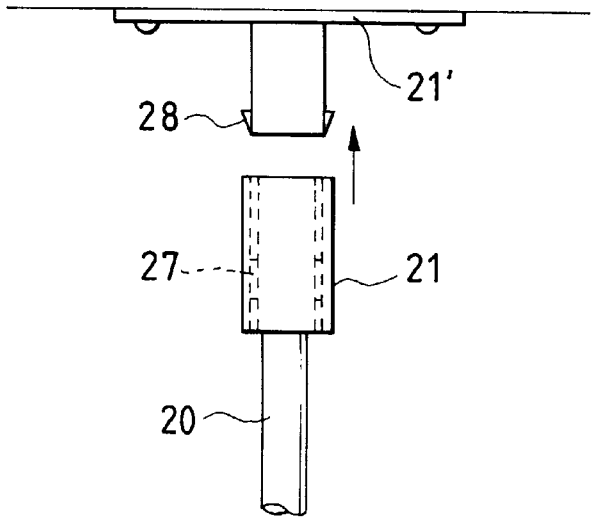

That is, as shown in FIG. 7A, there is formed a pawl meshing hole 27 in the mirror-side connector 21 and there is provided on the roof-side connector 21' a locking pawl 28 which can be fitted with the pawl meshing hole 27 of the mirror-side connector 21, whereby the two connectors 21 and 21' can be fixed together with one touch.

Figure 8:
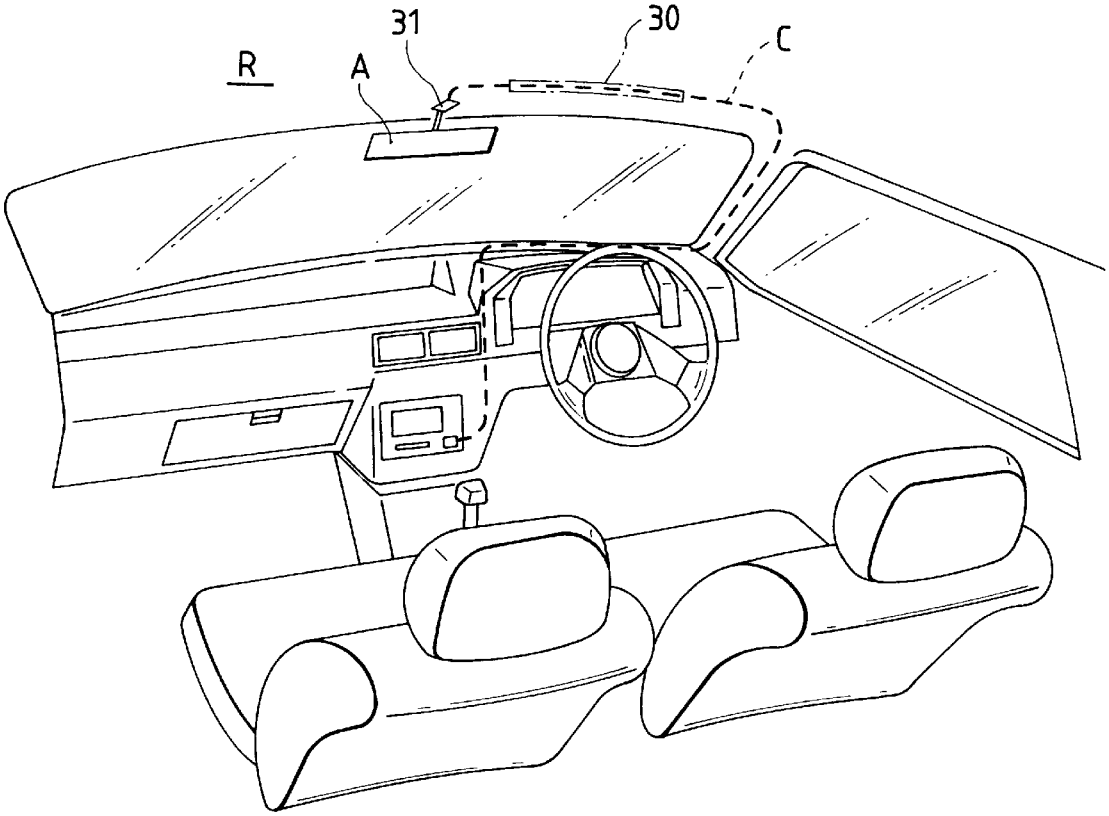
FIG. 8 is an explanatory view of the operation of a third embodiment of a car antenna according to the invention.

Now, FIG. 8 shows a third embodiment of a car antenna according to the invention, in which a pipe 30 is provided between the connector 21' disposed on the roof R and the main body of the car navigation device.

That is, as shown in FIG. 8, according to the third embodiment, in a wiring line for connection between the roof-side connector 21' and the car navigation main body, namely, in a line extending from the roof R through a pillar to an instrumental panel, there is disposed the pipe 30 which has been formed of inexpensive vinyl chloride or urethane previously (that is, at the time when the body of the car is manufactured).

With use of this structure, if the leading end of the cable C is inserted into a wiring opening 31 of the roof R and the cable C is then fed further by hand, then the cable C can be inserted down to the main body of the car navigation device.

As a result of this, even when the present car antenna A is installed later, a wiring operation can be achieved without removing the upholstery of the interior of the car, that is, the wiring operation can be executed very easily.

By the way, the roof-side connector 21' is installed after completion of the wiring operation. In this operation, if the connector 21' can be installed electrically by pressure contact, then the efficiency of the operation can be improved.

In other words, according to the present embodiment, when mounting the car antenna A, the cable C is inserted through the pipe 30 from the wiring opening 31 previously formed in the roof R, and the thus inserted cable C is then connected to the main body of the car navigation device. Next, the roof-side connector 21' is installed into the wiring opening 31, the connector 21 of the car antenna A is fitted into the thus installed connector 21', and the two connectors are screwed and fixed together, which completes the mounting operation of the car antenna A.

As described above, the previous provision of the pipe 30 facilitates the wiring operation of the cable C when mounting the car antenna A. Also, since the thus wired cable C is invisible, the appearance of interior of the car is fit to be seen. Further, because the wiring operation can be executed without removing the instrumental panel, the wiring operation can be achieved with high efficiency. In addition, due to use of the connectors 21 and 21', the connection of the cable C with the built-in antenna a can be achieved at the same time when the mirror 1 is mounted, which in turn facilitates the connecting operation of the car antenna A with the built-in antenna a.

Next, as a fourth embodiment of the invention, there is shown a structure in which a car antenna A can be additionally attached to a previously arranged rearview mirror 1 as an option.

Figure 9A:
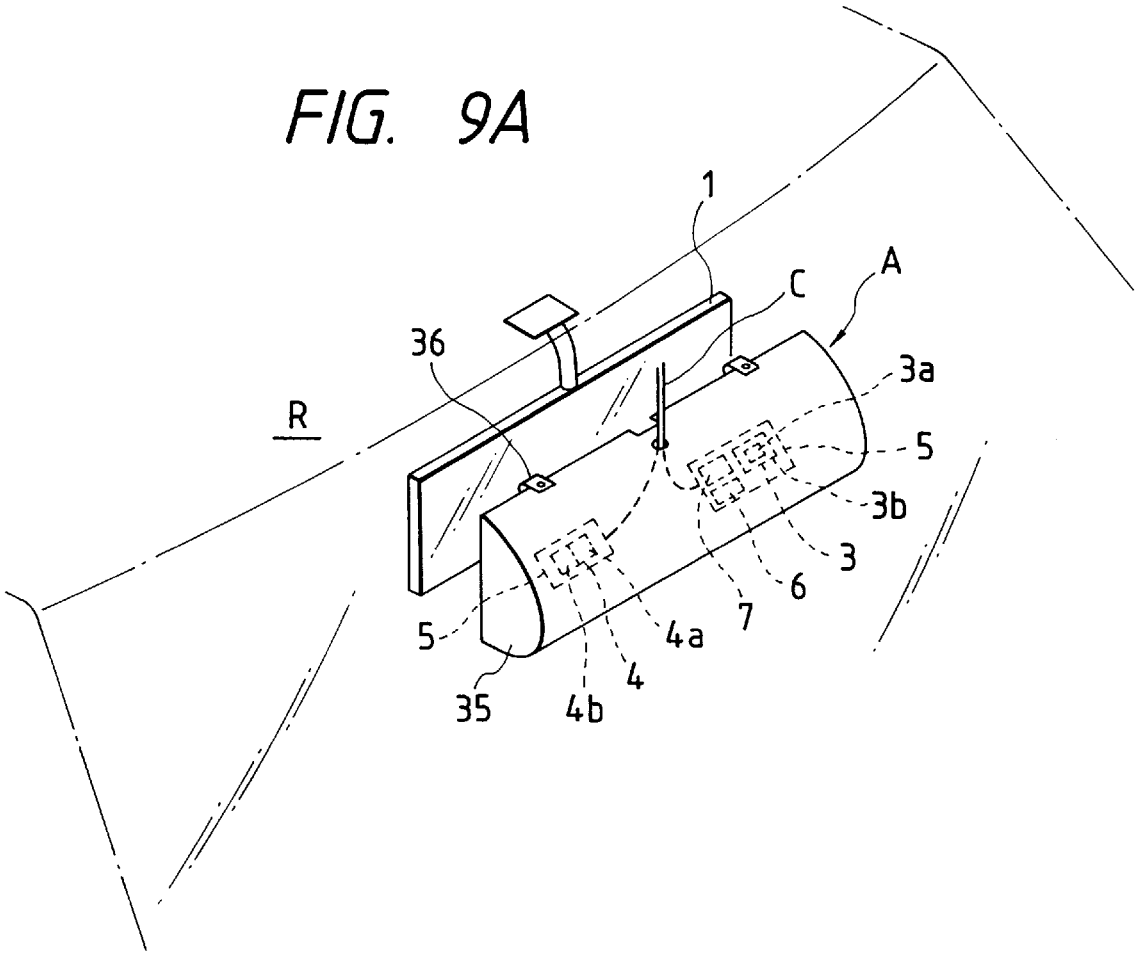
FIG. 9A is an exploded perspective view of a car antenna of a fourth embodiment according to the invention.
Figure 9B:
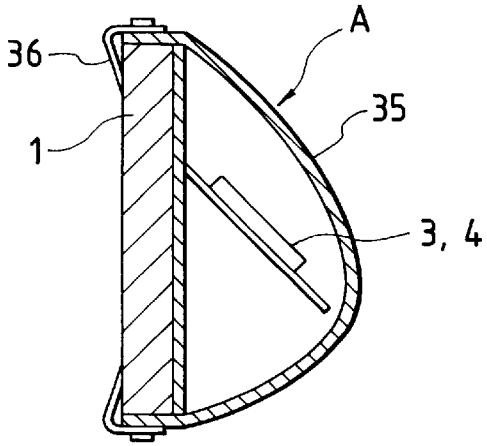
FIG. 9B is a section view of the main portions of the fourth embodiment.

According to the fourth embodiment, as shown in FIGS. 9A and 9B, for example, there is provided a case 35 including an engaging surface to be fitted with the back surface of the rearview mirror 1, and the built-in antenna a discussed in the first embodiment is disposed in the case 35.

That is, on the engaging surface side of the case 35, there are provided a total of four engaging pawls 36 which are respectively arranged at the two spaced positions of the respective upper and lower portions of the engaging surface. The engaging pawls 36 are respectively made in the form of springs which are structured such that, if they are caught on the rearview mirror 1, then they are pressed against the rearview mirror 1 as shown in FIG. 9B, thereby preventing the case 35 from being loose or dropping down from the rearview mirror 1.

Also, as shown in FIG. 9B which is a section view of the rearview mirror 1 and the case 35, the case 35 is structured in an expanded shape, which allows the case 35 to hold the built-in antenna a in an inclined manner.

Further, since the windshield side of the case 35 is formed semi-transparent, the case 35 is able to receive and transmit a signal with respect to an optical beacon.

In the present embodiment, as the built-in antenna a, there can be used the same one as has been described in the first embodiment with reference to FIGS. 2 to 4 and thus the description thereof is omitted here.

The present embodiment is structured in the above-mentioned manner and, therefore, when the present car antenna A is mounted in such a manner that the engaging surface of the case 35 is fitted with the back surface of the rearview mirror 1 and the pawls 36 are engaged with their corresponding portions of the rearview mirror 1 back surface, then the signal receiving surface of the built-in antenna a is caused to face the windshield of the car. Also, as shown in FIG. 9A, the cable C is extended out from the car antenna A and thus, if the cable C is connected with the main body of the car navigation device, then the present car antenna A is able to receive and transmit, through the windshield of car, signals with respect to not only the wave beacons for the GPS and VICS/automatic rate but also the optical beacon which are respectively arranged above the position of the car.

The present structure eliminates the need to mount the antenna on the car body or instrumental panel, thereby being able to enhance the appearance of the interior of the car. Also, since the present car antenna A is mounted onto the rearview mirror 1, the car antenna A is invisible to the eyes of a driver and is kept from reflecting its shadow onto the windshield, thereby eliminating the possibility that the driver can be made uncomfortable due to the reflected shadow of the car antenna A.

Further, because the wave combining device 6 and amplifier 7 can also be incorporated into the car antenna A together with the built-in antenna a, not only the number of cables necessary for connection therebetween but also the number of connectors used for such cables can be reduced. This can reduce the costs of the parts of the car antenna A as well as can simplify the car antenna mounting operation.

Figure 10:
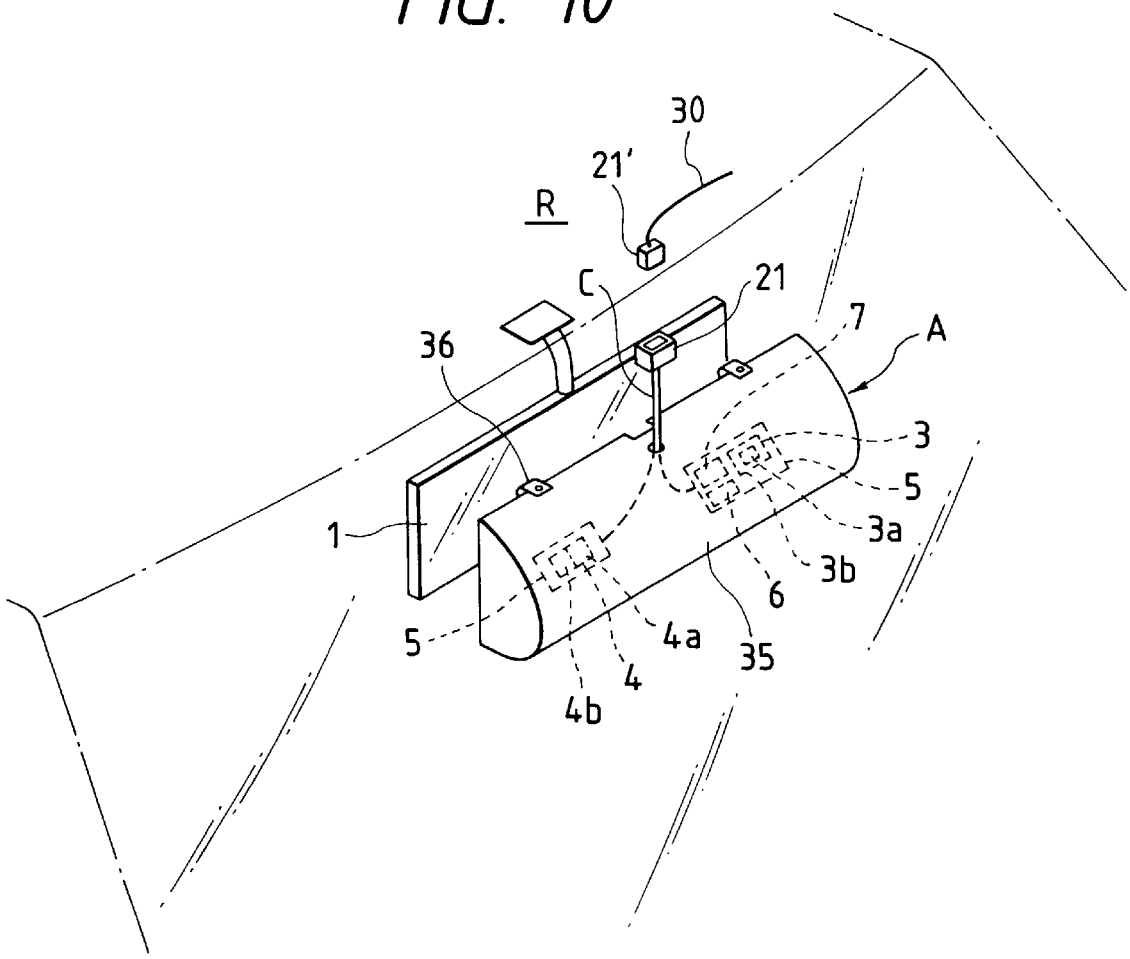
FIG. 10 is an exploded perspective view of a car antenna of a fifth embodiment according to the invention.

Now, as a fifth embodiment of the invention, in the car antenna A according to the fourth embodiment of the invention (that is, the structure in which a car antenna can be additionally attached to the rearview mirror as an option), there is provided a structure which, as shown in FIG. 10, a pipe 30 is arranged between the connector 21' disposed on the roof R and the car navigation device, so that the connector 21' can be connected with the connector 21 of the car antenna A through the pipe 30.

That is, similarly to the previously described third embodiment, for example, as shown in FIG. 8, in a wiring line for connection between the roof-side connector 21' and the car navigation main body, namely, in a line extending from the roof R through a pillar to an instrumental panel, there is disposed the pipe 30 which has been formed of inexpensive vinyl chloride or urethane previously (that is, at the time when the body of the car was manufactured).

On the other hand, on the cable end of the car antenna A, there is provided a male connector 21.

In the present embodiment, with use of the above structure, when mounting the car antenna A onto the rearview mirror 1, the cable C is inserted from a wiring opening 31 which has been previously formed in the roof R to a pipe 30, and the cable C is then connected with the main body of the car navigation device. Next, the roof-side connector 21' is attached to the wiring opening 31. Then, the connector 21 of the car antenna A of a type to be mounted onto the rearview mirror 1 is fitted into the roof-side connector 21', which completes the mounting of the present car antenna A.

As described above, in the car antenna A, since the cable C is inserted into the previously arranged pipe 30 so that the cable C can be connected with the main body of the car navigation device through the pipe 30, the wiring operation of the cable C can be simplified. In addition, the thus wired cable C is not visible to the eyes of a driver and a passenger, which improves the appearance of the interior of the car. Further, the wiring operation can be achieved without removing the instrumental panel, resulting in the enhanced operation efficiency.

Next, FIGS. 11A to 13B show sixth and seventh embodiments of an improved structure of a rearview mirror according to the invention.

Figure 11A:
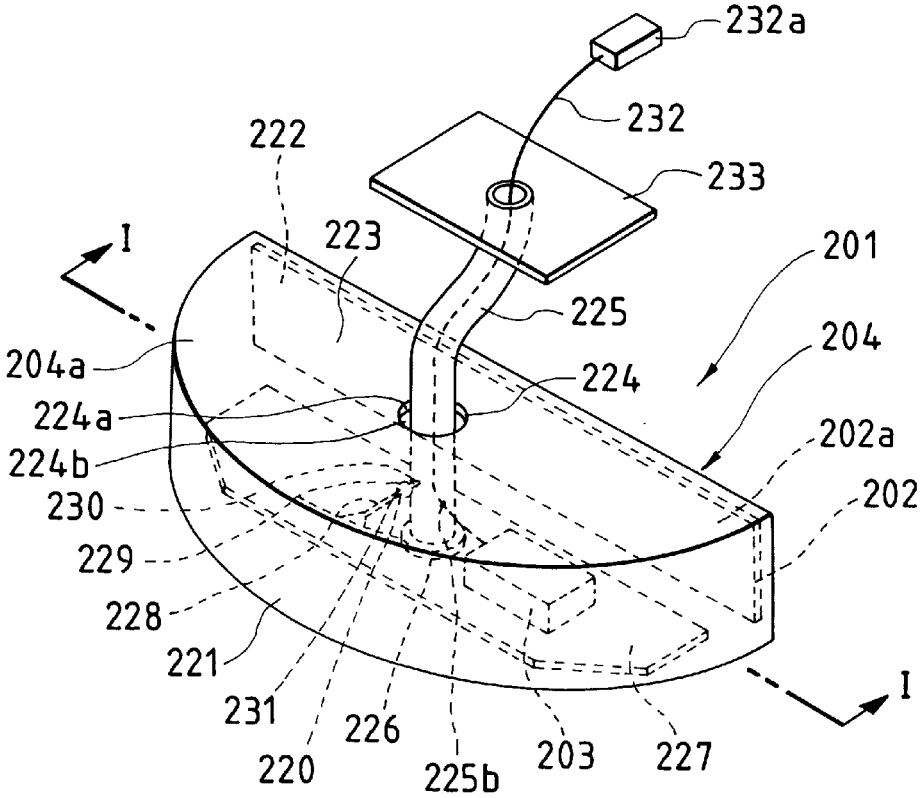
FIG. 11A is a perspective view of a structure of a room mirror of a sixth embodiment according to the invention.
Figure 11B:
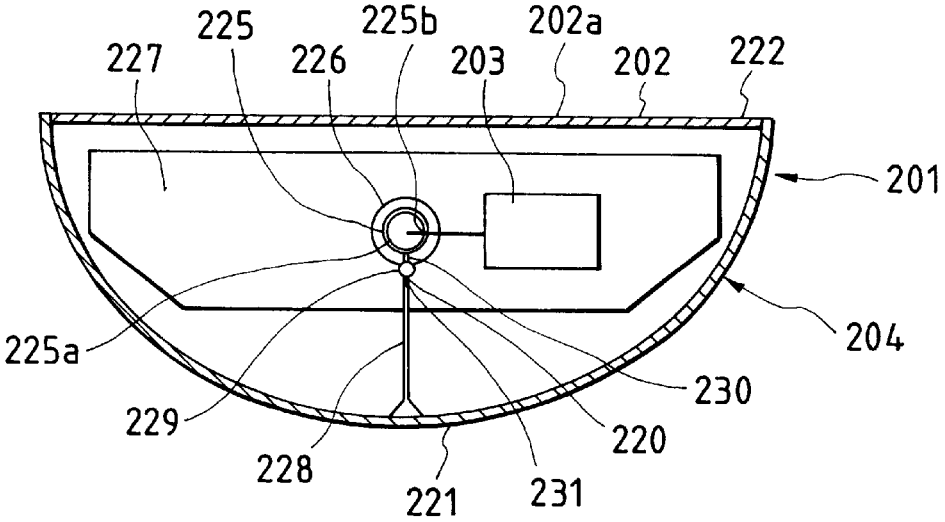
Fig. 11B is a section view of the sixth embodiment, taken along the line I—I shown in FIG. 18A.

As shown in FIGS. 11A and 11B, in a rearview mirror 201 according to a sixth embodiment of the present invention, the side surface of a box body 204, which incorporates therein a directional devices 203 to be mounted into the vehicle in combination with the rearview mirror 201, includes an arc-shaped surface 221 and a plane 222, a mirror main body 202 is fixed to the plane 222 portion of the box body 204, and the surface of the mirror main body 202 provides a mirror surface 202*a*.

An upper surface 223 of the box body 204 is opened up to form an opening 224, and a support member 225 for supporting the box body 204 is inserted from outside into the box body 204 through the opening 224. The end portion of the support member 225 existing in the interior of the box body 204 is formed as a flange 226, a mounting plate 227 for mounting the directional devices 203 such as the above-mentioned collision prevention camera, navigation system and the like is fixed to the flange 226, and the devices 203 are respectively fixed to the mounting plate 227.

On the other hand, a rod-like projection 228 is provided on and projected perpendicularly from the substantially peripherally central portion of the inner surface of the arc-shaped surface 221 of the box body 204, while the leading end portion of the projection 228 is formed as a semi-spherical shell portion 229. Besides, within the box body 204, another rod-like projection 230 is also provided on and projected from a peripheral surface 225*a* of the support member 225 of the box body 204, while the leading end portion of the projection 230 is formed as a spherical portion 231 which can be loosely fitted with the inner surface of the semi-spherical shell portion 229. That is, according to the present embodiment, within the box body 204, there is provided a moving ball mechanism 220, due to which the box body 4 can be moved three-dimensionally in an arbitrary direction about the center of the semi-spherical shell portion 229 and, after the box body 204 is moved in such direction and the direction of the box body 204 is determined, the box body 4 can be fixed in the determined direction.

According to the above-mentioned structure, the devices 203 are fixed immovably to the support member 225 of the box body 204 through their mounting plate 227, whereas the mirror main body 202, in particular, the box body 204, to which the mirror main body 202 is fixed, is mounted to the support member 225 in a movable manner. Due to this, even if the direction of the box body 204 is changed to thereby change the direction of the mirror main body 202, the devices 203 are left unmoved. In other words, since the direction of the mirror main body 202 can be changed by moving the box body 204, there is no need to touch the mirror surface 202*a*, that is, the direction of the mirror main body 202 can be operated by hand without contaminating the mirror surface 202*a* with a dirty hand or the fingerprint thereof.

In addition, although not shown, the box body 204 may be mounted to the mounting plate 227 for fixing the devices 203 by use of the moving ball mechanism 220, so that the box body 204 not only can be freely moved in an arbitrary direction with respect to the mounting plate 227 but also can be then fixed to the mounting plate 227 in such direction. In this case, the box body 204 can be moved independent of the fixed state of the devices 203.

However, in the above-mentioned moving mechanism of the box body 204, even if the box body 204 is moved, the box body 204 must be moved in such a manner that the movement of the box body 204 must not interfere with the support member 225. For this purpose, an opening 224, which is formed in the box body 204 and through which the support member 225 can be inserted, must be large in size to thereby be able to provide play 224*b*.

Additionally, according to the present embodiment, the support member 225 for supporting the box body 204 is so formed as to have a hollow portion therein, while a cable 232 for the devices 203 is introduced into the interior of the support member 225 through an opening 225*b* formed in the peripheral surface 225*a* of the support member 225, is guided to the hollow interior portion of the support member 225, and is finally guided through the hollow interior portion of the support member 225 to the outside. If the cable 232 is arranged or connected through the interior portion of the support member 225 in this manner, then the cable 232 can be protected by the support member 225, thereby eliminating the fear that the surface of the cable 232 can be damaged. Further, since the cable 232 is guided through the interior portion of the support member 225, the design of the rearview mirror can also be improved.

By the way, in FIGS. 11A and 11B, reference character 232*a* designates a connector for the cable 232, while 233 stands for a mounting plate which is used to mount the support member 225 onto the roof part of the vehicle and also which can be installed by a screw (not shown) or the like.

In a seventh embodiment of a structure of a rearview mirror according to the invention, in addition to the structure according to the above-mentioned sixth embodiment, as shown in FIGS. 12A to 13B, there is employed an antivibration structure in the portion of the opening of the box body 204 into which the support member 225 can be inserted.

In particular, in the sixth embodiment, as an antivibration structure, between the peripheral surface 225*a* of the support member 225 and the inner peripheral surface 224*a* of the insertion opening 224 of the box body 204, there is provided a clearance 224*b* which gives such freedom as allows the box body 204 to move. That is, generally, if the vibration of the running vehicle is transmitted to the mirror main body 202, then the box body 204 is also caused to vibrate. The above-mentioned antivibration structure aims at relieving such vibration of the box body 204.

Figure 12A:
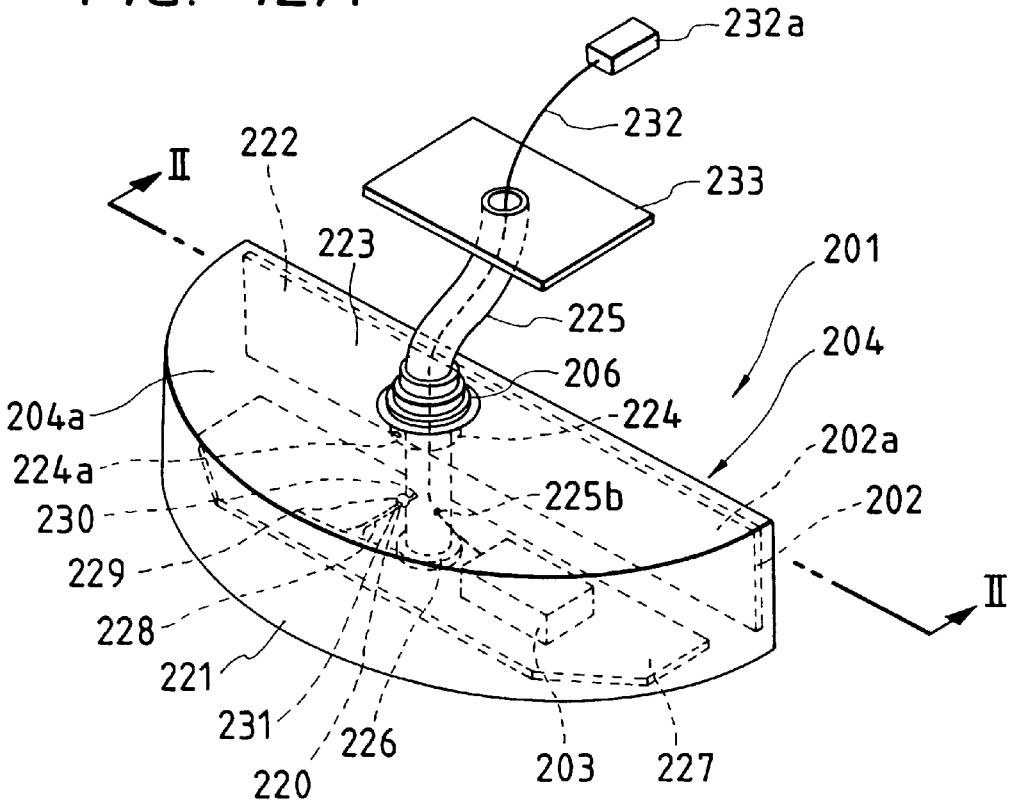
FIG. 12A is a perspective view of a structure of a room mirror of a seventh embodiment according to the invention.
Figure 12B:
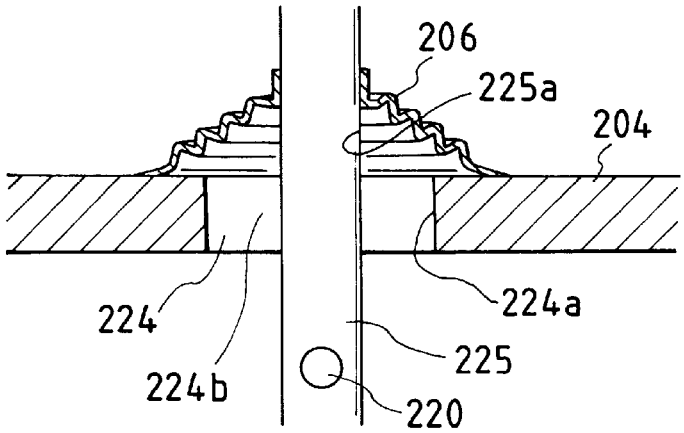
FIG. 12B is a section view of the seventh embodiment, taken along the line II—II shown in FIG. 19A.

In more particular, as the present antivibration structure, as shown in FIGS. 12A and 12B, there is provided a bellows 206 which not only connects the peripheral surface 225*a* of the support member 225 of the rearview mirror 201 to the upper surface 223 of the box body 204 but also covers the peripheral surface 225*a* of the support member 225.

The bellows 206 is formed of rubber, and what is most important is that the bellows 206 does not interfere with the adjustment of the direction of the box body 204 to be made by the moving ball mechanism 220. That is, according to the hardness (elastic modulus) of the rubber forming the bellows 206 and the shape of the bellows 206, there can occur a case in which the elastic force of the bellows 206 can overcome the frictional force that is produced between the spherical portion 231 of the moving ball mechanism 220 and the semi-spherical shell portion 229 fitted with the spherical portion 231, which makes it impossible to fix the box body 204 in a desired direction with respect to the support member 225. For this reason, the bellows 206 must be designed in consideration of the elastic modulus of the rubber forming the bellows 206 as well as the shape of the bellows 206, in particular, the pitch of the bellows 206, the diameter of the bellows 206, the thickness of the rubber forming the bellows 206 and the like.

Figure 13A:
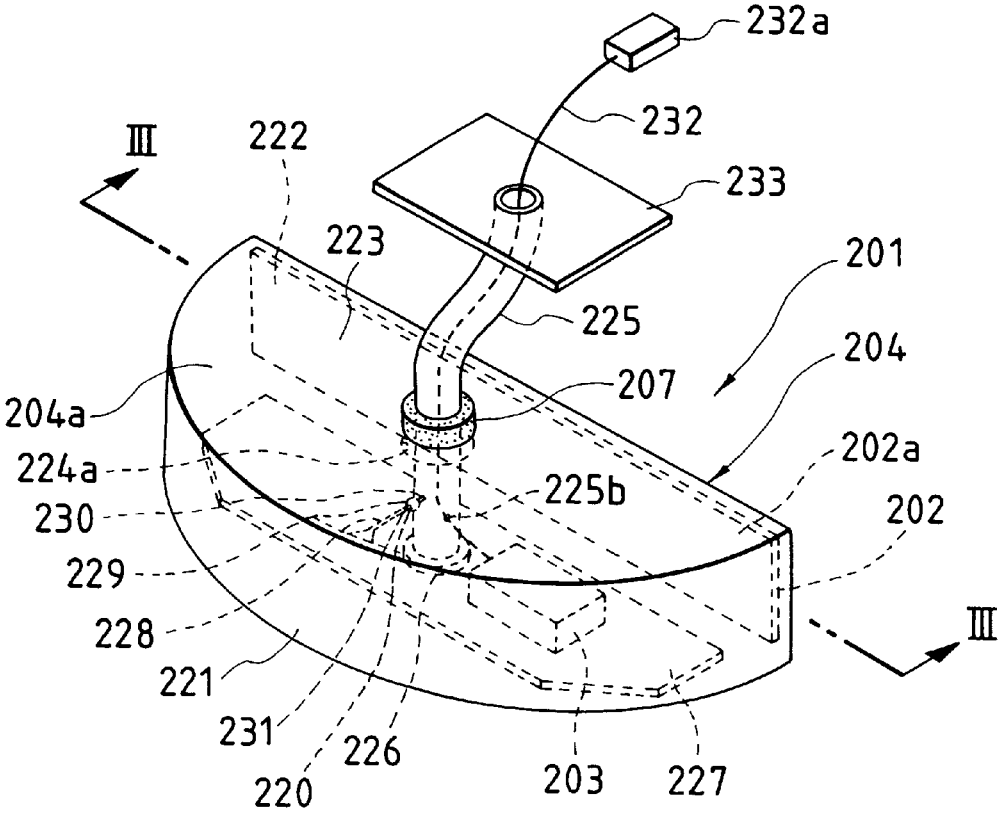
FIG. 13A is a perspective view of a modification of the seventh embodiment according to the invention.
Figure 13B:
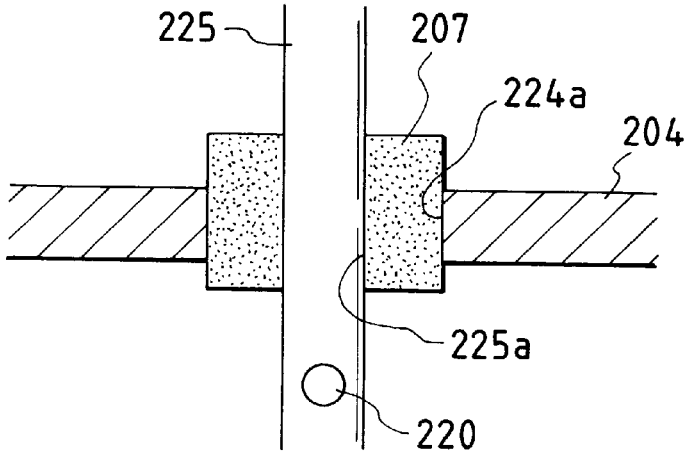
FIG. 13B is a section view of the seventh modification, taken along the line III—III shown in FIG. 20A.

Additionally, as an antivibration structure, besides the above-mentioned bellows 206, as shown in FIGS. 13A and 13B, in the clearance 224*b* that is provided between the peripheral surface 225*a* of the support member 225 and the inner peripheral surface 224*a* of the insertion opening 224 of the box body 204, there can be disposed a cylindrical-shaped vibration absorbing 20 body 207 in such a manner that it fills up the clearance 224*b*. As the vibration absorbing body 207, there can be used not only a body which is formed of elastic material such as rubber or the like, but also a body which is formed by enclosing highly viscous material such as sponge or the like with a thin film.

In this case, similarly to the above-mentioned bellows 206, only if the vibration absorbing body 207 is formed of the elastic material having such an elastic modulus or viscous material having such coefficient of viscosity as does not interfere with the fixation of the box body 204, then the vibration of the box body 204 can be absorbed without interfering with the adjustment and fixation of the box body 204 in an arbitrary direction. As such viscous material, in addition to the above, there are available highly viscous oils and the like.

As has been described in the sixth and seventh embodiments, in a rearview mirror with built-in directional devices such as a collision preventive detection camera, an optical beacon and the like, the adjustment of the mounting angle of the mirror main body can be achieved by hand without touching the mirror surface of the mirror main body while the spatial positions of the devices are left fixed. In addition, since no electric mechanism is required, when compared with an electrically operated rearview mirror, the interior structure of the rearview mirror can be simplified and reduced in weight as well as the cost of the rearview mirror can be reduced.

Further, due to provision of the antivibration structure between the support member for supporting and mounting the box body in a freely movable manner and the insertion opening of the box body for insertion of the support member, the vibration of the box body caused by the vibration of the running vehicle can be relieved.

Figure 14:
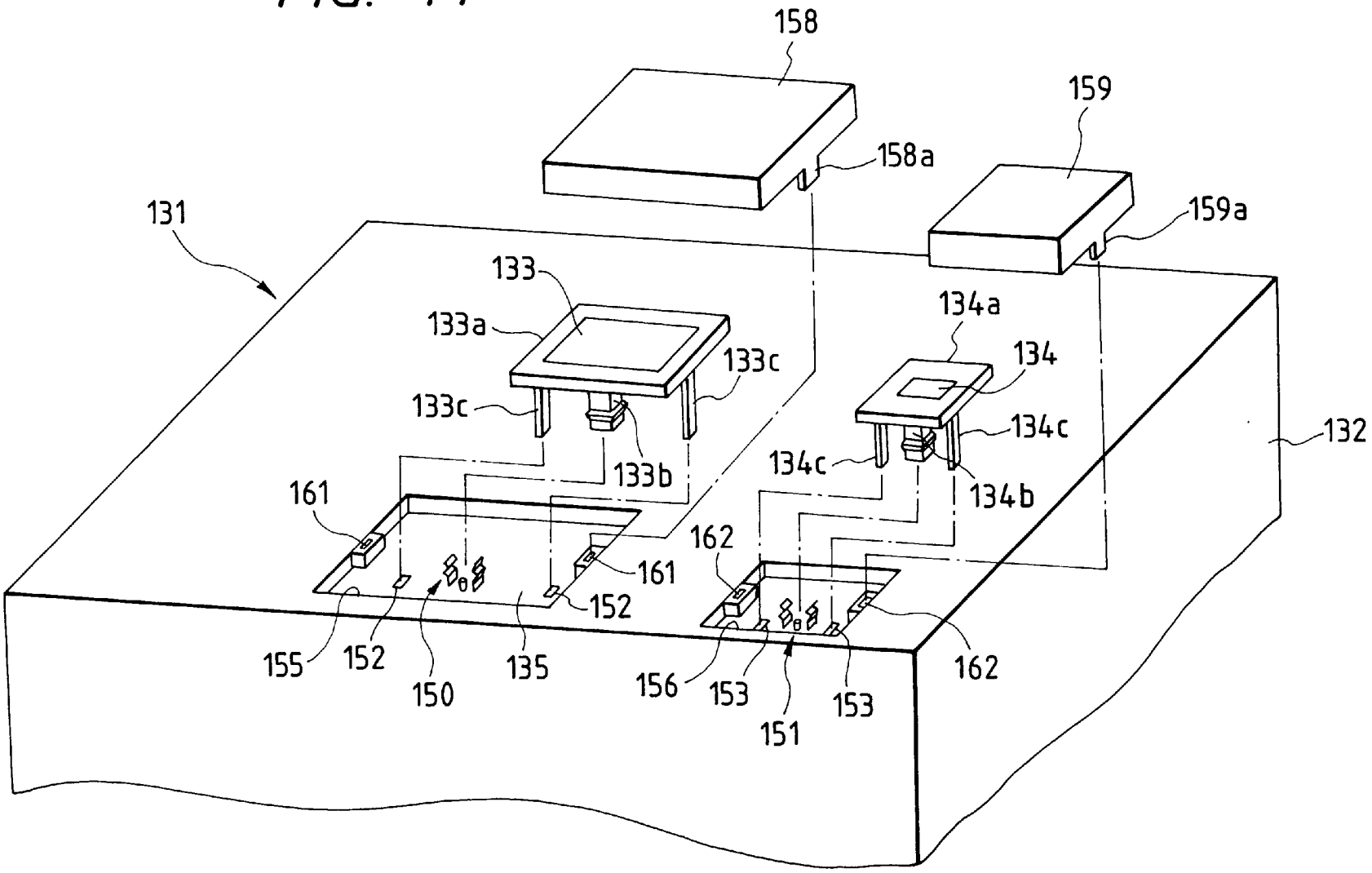
FIG. 14 is a schematically exploded, perspective view of an antenna device of an eighth embodiment according to the invention.
Figure 15:
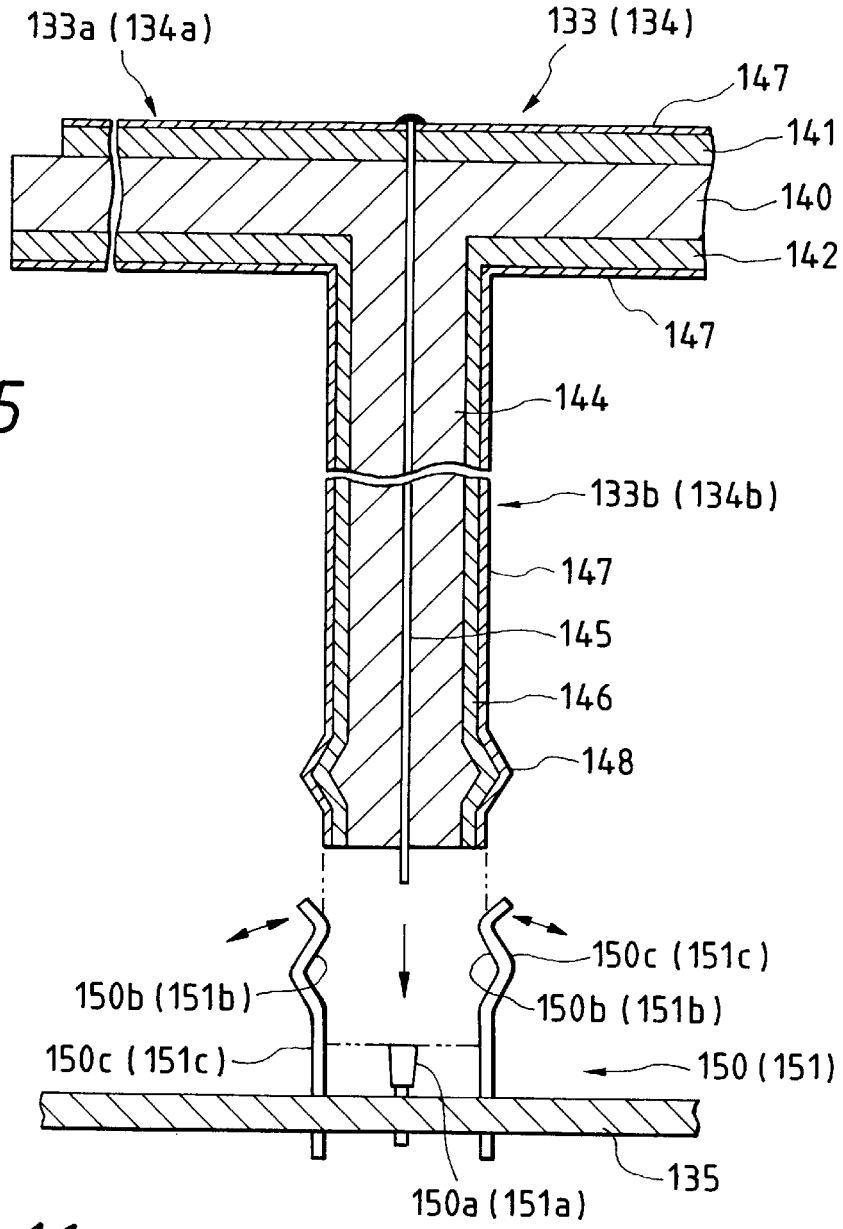
FIG. 15 is a section view of the main portions of the eighth embodiment.
Figure 16:
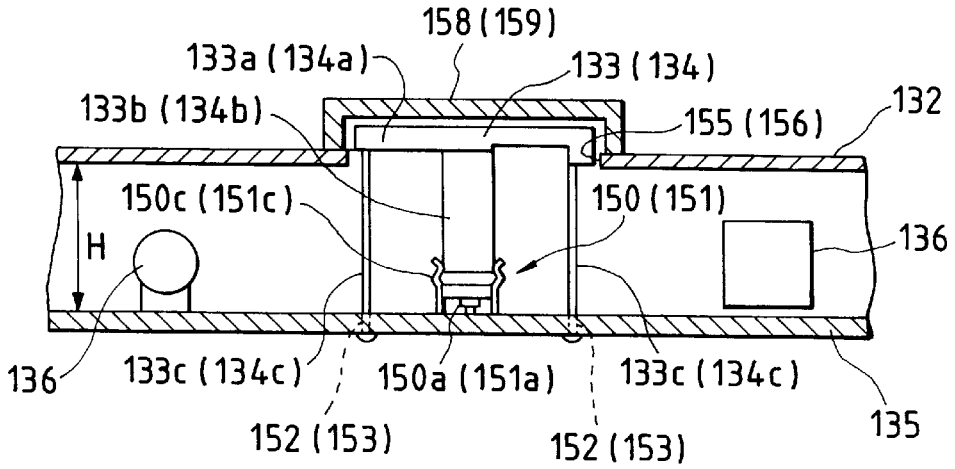
FIG. 16 is a section view of the main portions of the eighth embodiment.

Now, description will be given below of an eighth embodiment of an antenna device according to the invention. In FIGS. 14 to 16, reference character 131 designates a receiver unit which is carried on board a car or the like and is used as a communication device unit. Similarly to the above-mentioned conventional structure, in order to prevent deterioration of the antenna performance thereof, the receiver unit 131 is structured such that two antennas 133 and 134 of a flat-surface type for a microwave or the like are disposed on the upper surface portion of a metal case 132 which is also a component to form the receiver unit 131.

In the present embodiment, one antenna 133 is used to receive a signal transmitted from a GPS (Global Positioning System), whereas the other antenna 134 is used to receive a signal from a radio wave beacon.

On the upper portion of the receiver unit 131 situated within the case 132, there is disposed a circuit board 135 serving as a substrate part with given pieces of circuits formed thereon and, on the circuit board 135, similarly to the conventional antenna device, there are mounted necessary parts 136 properly according cases.

The antennas 133 and 134 respectively include antenna main bodies 133*a* and 134*a* each of a flat-surface type positioned on the upper surface portion of the case 132, signal transmission support members 133*b* and 134*b* provided integrally on and projected downwardly from the central portions of the lower surface sides of the antenna main bodies 133*a* and 134*a*, and mounting support members 133*c* and 134*c* provided integrally on and projected downwardly from the two side portions of the lower surface sides of the antenna main bodies 133*a* and 134*a*.

Each of the antenna main bodies 133*a* and 134*a*, as shown in FIG. 15, includes a flat-plate-shaped, high dielectric layer portion 140 which is formed of plastic system resin consisting mainly of dielectric material having a large dielectric constant such as high dielectric (for example, resin mixed with a potassium titanate whisker, or the like), a flat-surface-shaped, receiving conductor layer portion 141 which consists of copper plating or the like and is disposed on the upper surface side of the high dielectric layer portion 140, and a flat-surface-shaped, grounding conductor layer portion 142 which consists of copper plating or the like and is disposed on the lower surface side of the high dielectric conductor layer portion 140.

On the other hand, each of the signal transmission support members 133*b* and 134*b* includes a prism-shaped support main body portion 144 which is formed of the same material as the high dielectric layer portion 140 and is provided integrally on and projected downwardly from the lower surface side of the central portion of the high dielectric layer portion 140, an inner conductor 145 which is so disposed as to extend in the vertical direction within the support main body portion 144 along the axial direction thereof and is connected at the upper end portion thereof to the receiving conductor layer portion 141 by soldering or the like, and an outer peripheral conductor 146 which consists of copper plating or the like and also which is so mounted as to cover the outer peripheral surface of the support main body portion 144 and is connected to the grounding conductor layer portion 142.

Here, the signal transmission support members 133*b* and 134*b* are structured similarly to a so called coaxial cable and thus they respectively form high frequency transmission lines which are used to guide receiving signals.

By the way, on the upper surface side of the receiving conductor layer portion 141 and the lower surface side of the grounding conductor layer portion 142 of the antenna main body portion 133*a* (134*a*) as well as on the outer peripheral surface side of the outer peripheral conductor 146 of the signal transmission support member 133*b* (134*b*), there is provided a tin plating layer 147 for rust prevention.

Further, as shown in FIGS. 14 to 16, on the outer peripheral surface of the lower end portion of each of the signal transmission support members 133*b* and 134*b*, there is provided an outwardly projecting projection-strip-shaped securing portion 148 which is so arranged as to extend along the peripheral direction thereof.

On the other hand, the above-mentioned pair of mounting support members 133*c* and 134*c*, similarly to the signal transmission support members 133*b* and 134*b*, are respectively formed of the same material as the high dielectric layer portions 140 and are provided integrally on and projected downwardly from the lower surface side of the high dielectric layer portions 140, while the support members 133*c* and 134*c* are respectively formed in a thin prism shape. Additionally, the mounting support members 133*c* and 134*c* are formed slightly longer than the signal transmission support members 133*b* and 134*b*.

By the way, the mounting support members 133*c* and 134*c* may be structured such that they include the outer peripheral conductors 146 and tin plating layers 147, similarly to the signal transmission support members 133*b* and 134*b*, or they may be structured such that they do not include such components.

The circuit board 135 further includes not only antenna connecting portions 150 and 151 to which the respective lower end portions of the signal transmission support members 133*b* and 134*b* can be connected, but also insertion holes 152 and 153 through which the respective lower end portions of the mounting support members 133*c* and 134*c* can be inserted.

Further, the antenna connecting portion 150 and 151 respectively include not only connecting terminal bodies 150*a* and 151*a* serving as inner conductor connecting portions into which the respective lower end portions of the inner conductors 145 projected out from the respective lower ends of the signal transmission support members 133*b* and 134*b* can be inserted and connected, but also a pair of connecting terminal pieces 150*c* and 151*c* serving as outer peripheral conductor connecting portions respectively having securing recessed portions 150*b* and 151*b* which can be secured by means of elastic deformation thereof to the projection-strip-shaped securing portions 148 of the respective lower end portions of the signal transmission support members 133*b* and 134*b* in such a manner that the securing recessed portions 150*b* and 151*b* are detachably held from both sides by and between the securing portions 148.

Besides, with the lower end portions of the signal transmission support members 133*b* and 134*b* respectively connected to the antenna connecting portions 150 and 151, the lower end portions of the mounting support members 133*c* and 134*c* are respectively fitted or inserted into the insertion holes 152 and 153, and the circuit board 135 lower surface side projecting portions of the mounting support members 133*c* and 134*c* are respectively fused and connected to the antenna connecting portions 150 and 151, whereby the antennas 133 and 134 can be fixed to the circuit board 135 in such a manner that they are prevented against removal.

In addition, in the above-mentioned mounted state of the antennas 133 and 134, the antenna main body portions 133*a* and 134*a* of the antennas 133 and 134 are situated in such a manner that they respectively project upwardly of openings 155 and 156 respectively formed in the upper surface of the case 132.

Further, upper cover bodies 158 and 159 are respectively mounted on the antenna main body portions 133*a* and 134*a* in such a manner that they cover the respective upper portions of the antenna main body portions 133*a* and 134*a*. Also, these upper cover bodies 158 and 159 respectively include a pair of securing projection pieces 158*a* and 159*a* in the lower end edge portions of the two sides thereof. That is, if the securing projection pieces 158*a* and 159*a* of the upper cover bodies 158 and 159 are respectively inserted into and secured to securing holes respectively formed in securing portions 161 and 162 which are in turn provided in the peripheral edge portions of the openings 155 and 156, then the upper cover bodies 158 and 159 can be fixed to and held by the case 132 through such securing holes in such a manner that they are prevented against removal.

The present embodiment is structured in the above-mentioned manner. In other words, to manufacture the antennas 133 and 134, with the inner conductors 145 respectively set at a given position, the high dielectric layer portions 140, support member main body portions 144 and mounting support members 133*c* and 134*c* are firstly formed of plastic system resin consisting of high dielectric material into integral bodies, respectively; after then, the receiving conductor layer portions 141, grounding conductor layer portions 142 and outer peripheral conductors 146, which are all produced by copper plating, are respectively formed on the respective surfaces of the integral bodies; and, finally, the tin plating layers 147 are applied onto the copper plating components. That is, according to the present embodiment, the antennas 133 and 134 can be produced easily.

In addition, in the above-mentioned antenna integral formation, in order that the antenna main body portions 133*a* and 134*a* of the antennas 133 and 134 can be set at a given position according to a clearance height H between the circuit board 135 and the upper surface of the case 132 depending on the parts 136 mounted on the circuit board 135, the lengths of the signal transmission support members 133*b*, 134*b* and mounting support members 133*c*, 134*c* may be set properly. Due to this, the present embodiment is easily able to cope with various structures having different clearance heights H.

Further, when mounting the antennas 133 and 134 onto the circuit board 135, the lower end portions of the signal transmission support members 133*b* and 134*b* are respectively connected to the antenna connecting portions 150 and 151, the mounting support members 133*c* and 134*c* are respectively inserted into the insertion holes 152 and 153, and, after then, the circuit board 135 lower surface side projection portions of the mounting support members 133*c* and 134*c* may be respectively fused by means of electric heating, ultrasonic wave, or the like.

As described above, according to the present embodiment, there is provided a system in which signals received by the antenna main body portions 133*a* and 134*a* of the antennas 133 and 134 are directly transmitted to the circuit board 135 through the signal transmission support members 133*b* and 134*b*. With use of this system, not only a signal of high frequency can be transmitted at a low loss, but also there is eliminated the need for provision of the sub-substrates 108, 109, cable 110, connection connector 111, double-side adhesive tape 121 and the like which have been necessary in the above-mentioned conventional structure, which can reduce the number of parts used and can simplify the antenna mounting operation. That is, the present embodiment can reduce the cost as well as can improve the efficiency of the mounting operation.

Figure 17:
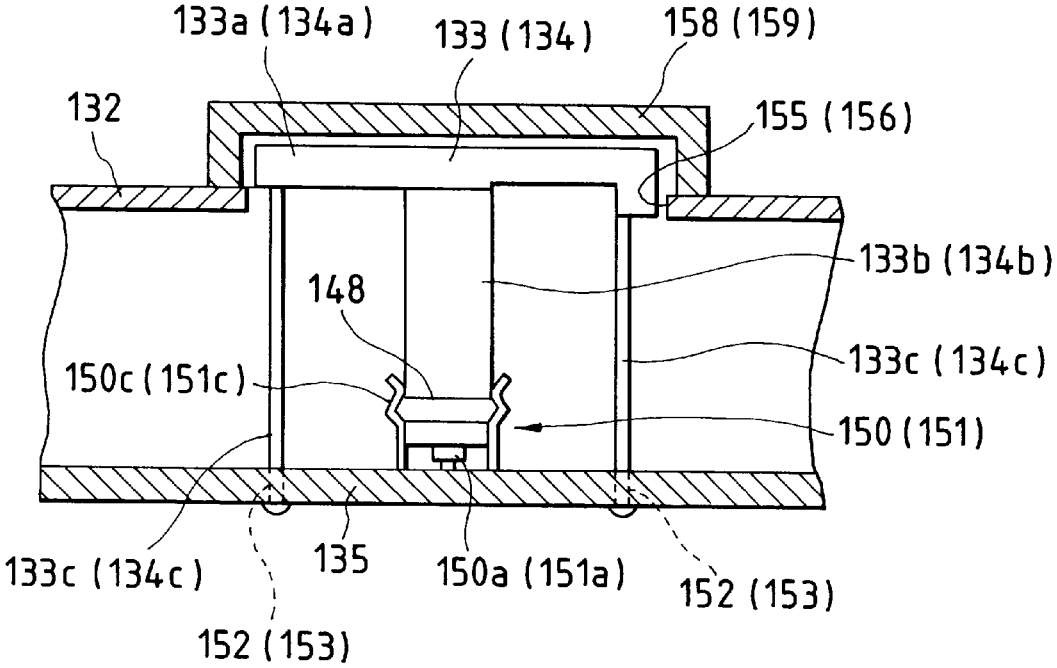
FIG. 17 is a section view of the main portions of an antenna device of a ninth embodiment according to the invention.

Now, FIG. 17 shows a ninth embodiment of an antenna device as a modification of the eighth embodiment according to the invention in which the one-side mounting support members 133*c* and 134*c* of the antennas 133 and 134 are respectively formed in a thick prism shape which is larger in section than the other-side mounting support members 133*c* and 134*c*.

According to the present embodiment, if the antennas 133 and 134 are mounted in the wrong direction, then the mounting support members 133*c* and 134*c* cannot be inserted into the insertion holes 152 and 153. This eliminates the need to mount the antennas 133 and 134 in consideration of the directional properties or directivities of the antennas. As a result of this, the antennas 133 and 134 can be always mounted easily in a given direction with respect to the circuit board 135, and the mounting of the antennas 133 and 134 in the wrong direction can be prevented effectively, thereby being able to improve the efficiency of the antenna mounting operation in this respect as well.

Figure 18:
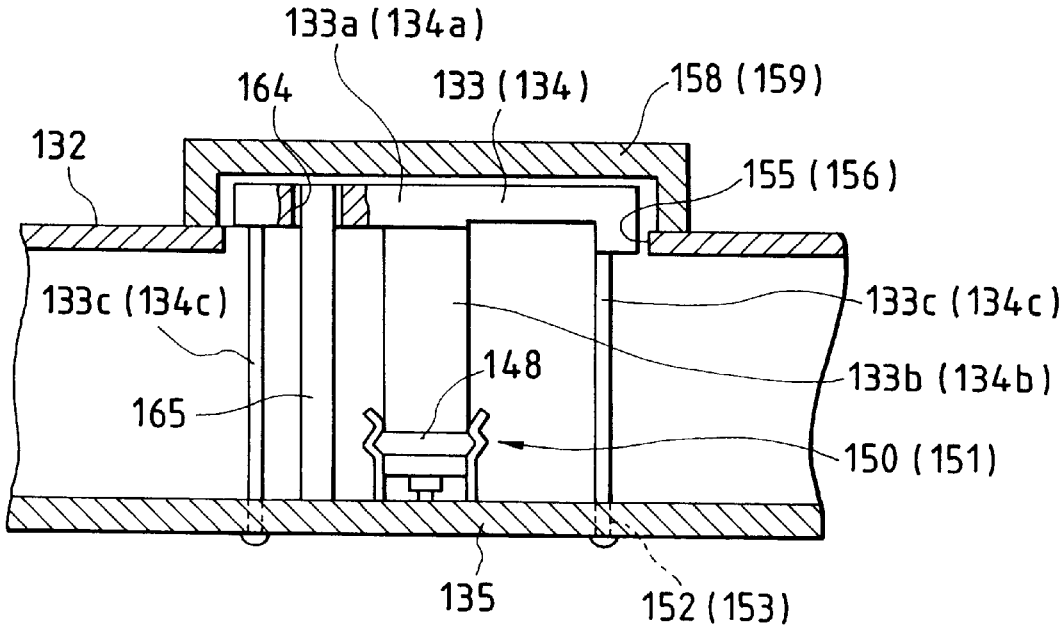
FIG. 18 is a section view of the main portions of an antenna device of a tenth embodiment according to the invention.

Now, FIG. 18 shows an tenth embodiment of an antenna device as a modification of the eighth embodiment according to the invention in which, on one side of each of the antenna main body portions 133*a* and 134*a* of the antennas 133 and 134, there is formed a positioning hole 164 serving as a recessed portion for positioning in such a manner that the positioning hole 164 extends through its corresponding main body portion in the vertical direction, while there are provided on and projected from the circuit board 135 fitting support members 165 serving as fitting portions which can be fitted into the above-mentioned positioning holes 164 when the antennas 133 and 134 are mounted onto the circuit board 135.

According to the present embodiment as well, similarly to the previously-mentioned ninth embodiment, if the antennas 133 and 134 are mounted in the wrong direction, then the fitting support members 165 cannot be fitted into the positioning holes 164. This eliminates the need to mount the antennas 133 and 134 with the directivities thereof taken into account, and also makes it possible to always mount the antennas 133 and 134 easily in a given direction with respect to the circuit board 135 to thereby prevent effectively the antennas 133 and 134 from being mounted in the wrong direction, with the result that the efficiency of the antenna mounting operation can be improved in this respect as well.

As a modification of the third embodiment, there may be provided projecting portions on the lower surface sides of the antenna main body portions 133*a* and 134*a*, and, on the circuit board 135, there may be provided recess-like fitting portions into which the projecting portions can be fitted.

Besides, as another modification of the tenth embodiment, a plurality of mounting support members 133*c* and 134*c* may be provided and the plurality of mounting support members 133*c* and 134*c* may be arranged asymmetrically with respect to the antenna main body portions 133*a* and 134*a*. This modified structure is also able to prevent the antennas 133 and 134 from being mounted in the wrong direction, thereby being able to improve the efficiency of the antenna mounting operation.

Further, as still another modification, in the mounting support members 133*c* and 134*c*, there may be formed projecting strips or recessed grooves which extend along the longitudinal direction of the mounting support members 133*c* and 134*c*, and the projecting strips or recessed grooves may be formed in such a manner that the section shapes thereof are asymmetric to each other. This modified structure is also able to prevent the antennas 133 and 134 from being mounted in the wrong direction, thereby being able to improve the efficiency of the antenna mounting operation.

Figure 19:
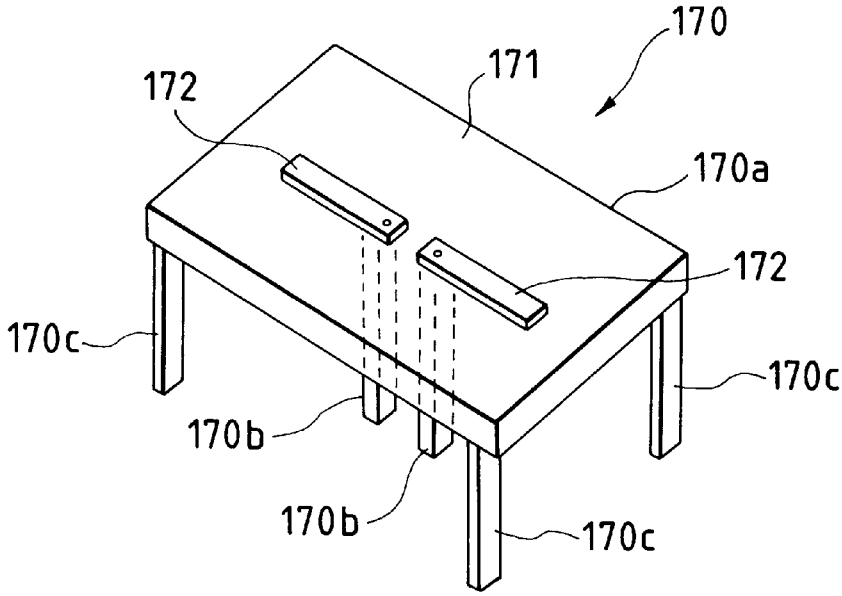
FIG. 19 is a section view of the main portions of an antenna device of an eleventh embodiment according to the invention.
Figure 20:
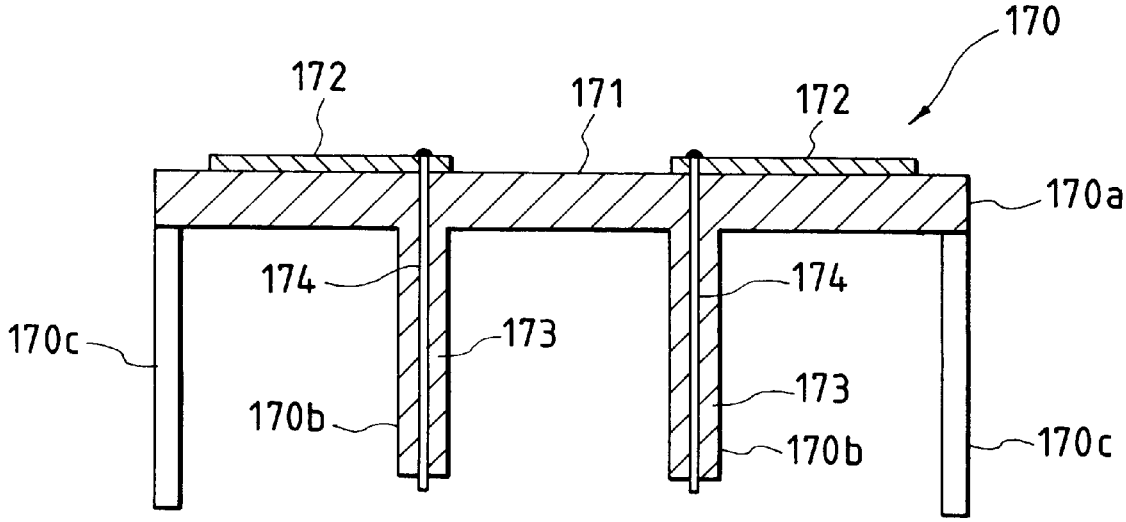
FIG. 20 is a section view of the main portions of the eleventh embodiment.
Figure 21:
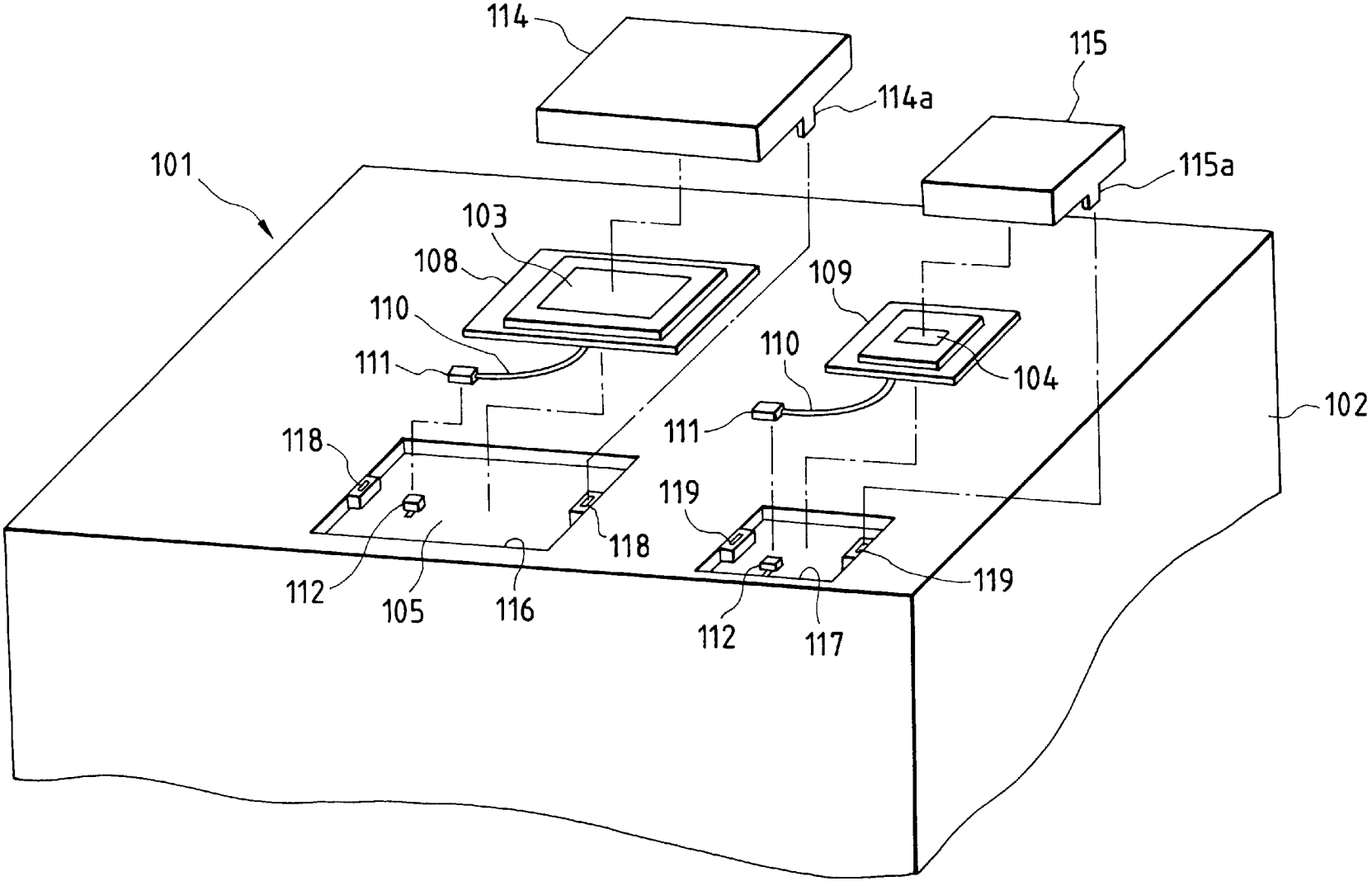
FIG. 21 is a schematically exploded, perspective view of a conventional antenna device.
Figure 22:
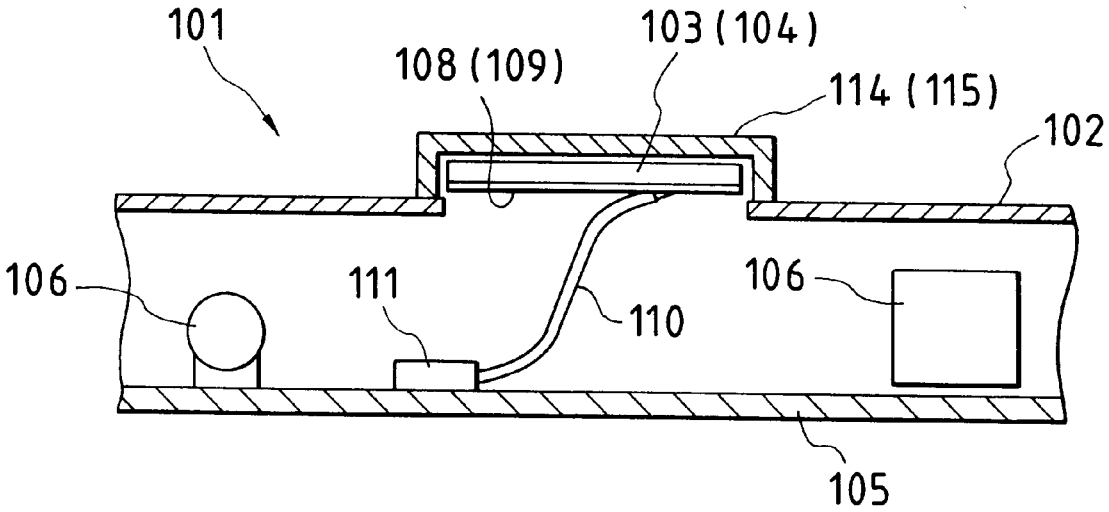
FIG. 22 is a section view of the main portions of the conventional antenna device; and, FIG. 23 is an exploded, perspective view of the same part shown in FIG. 22.
Figure 23:
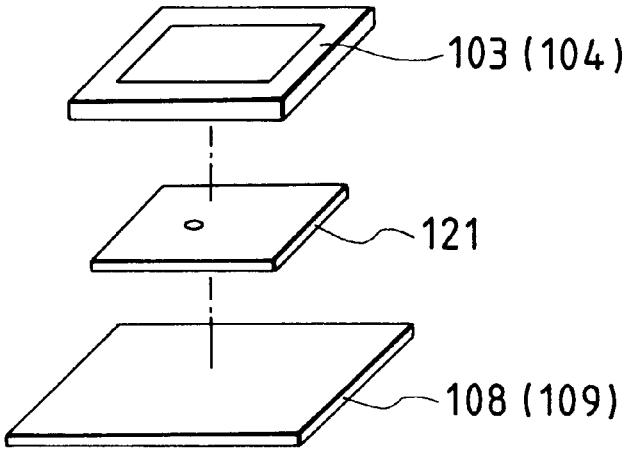

Now, FIGS. 19 and 20 show an eleventh embodiment of an antenna device as a modification of the eighth embodiment according to the invention in which there is provided an antenna 170 such as a dipole antenna or the like of a structure excluding the above-mentioned grounding conductor layer portion 142. That is, the present antenna 170 includes an antenna main body portion 170*a* of a flat-surface type, as well as two signal transmission support members 170*b* provided integrally on and projected downwardly from the central portion of the lower surface side of the antenna main body portion 170*a* and four mounting support members 170*c* respectively provided integrally on and projected downwardly from the four corner portions of the lower surface side of the antenna main body portion 170*a*.

The above-mentioned antenna main body portion 170*a* includes a high dielectric conductor layer portion 171 which is formed in a flat plate shape, and two flat-surface-shaped receiving conductor layer portions 172 which are respectively provided on the upper surface side of the high dielectric layer portion 171. Further, each of the two signal transmission support members 170*b* includes a prism-shaped support member main body portion 173 which is formed of the same material as the high dielectric conductor layer portion 171 and is provided integrally on and projected downwardly from the lower surface side of the central portion of the high dielectric layer portion 171, and an inner conductor 174 which is so disposed as to extend vertically within the support member main body portion 173 along the axial direction thereof and is connected by soldering or the like to the corresponding receiving conductor layer portion 172.

Additionally, the mounting support members 170*c* are also formed of the same material as the high dielectric conductor layer portion 171 and are provided integrally on and projected downwardly from the high dielectric conductor layer portion 171.

Similarly to the previously described embodiments, the present antenna 170 can also be mounted onto the circuit board which is provided on the receiver or transmitter side.

By the way, in the above-mentioned eighth to eleventh embodiments, there are shown the structures in which the signal transmission support members 133*b* and 134*b* are respectively formed in a prism shape. However, they can also be formed in a cylindrical shape. That is, according to the invention, the shapes of the signal transmission support members 133*b* and 134*b* are not limited to the shapes shown in the illustrated embodiments.

Besides, in the above-mentioned eighth to eleventh embodiments, there is shown the structure which includes the signal transmission support members 133*b*, 134*b*, 170*b* and mounting support members 133*c*, 134*c*, 170*c*. However, according to the invention, it is also possible to employ another structure in which the signal transmission support members 133*b*, 134*b*, 170*b* are so arranged as to be able to perform the functions of the mounting support members and thus the mounting support members 133*c*, 134*c*, 170*c* are not provided as independent parts.

Further, in the above-mentioned eighth to eleventh embodiments, there is shown the structure which uses the plastic system resin as the high dielectric. However, this is not limitative but, for example, there can also be used ceramics or other kinds of material for this purpose.

Still further, in the above-mentioned eighth to eleventh embodiments, there is shown the structure in which the receiving conductor layer portion 141 and grounding conductor layer portion 142 are formed by use of copper plating. However, according to the invention, it is also possible to employ another structure in which the receiving conductor layer portion 141 and grounding conductor layer portion 142 are formed by use of other metal plating, or by use of a metal plate, or the like.

Moreover, although, in the above-mentioned eighth to eleventh embodiments, there is shown the case in which the present invention is enforced in the receiver unit 131, the present invention can also be enforced as an antenna device in a transmitter unit. In this case,. the sensitive conductor layer portion functions as a transmission conductor layer portion.

In addition, the fixing structure for fixing the mounting support members 133*c* and 134*c* may be replaced by screws, or a removal preventive securing structure, or the like. Besides, the fixing structure is not limited to one which uses the fusion system.

As has been described in the eighth to eleventh embodiments, there is employed a method in which signals received at the antenna main body portion are transmitted directly to the substrate part side through the signal transmission support member. The present structure eliminates the need for provision of a sub-substrate, a cable, a connection connector, a double-side adhesive tape and the like which have been used in a conventional structure, thereby being able to not only reduce the number of parts used but also simplify the antenna mounting operation. As a result of this, the cost of the antenna device can be reduced and the mounting operation of the antenna device can be improved.

In addition, there can also be employed other structures as follows: that is, a structure in which the antenna main body portion includes a positioning recessed portion or projecting portion in the lower surface side thereof, and the substrate part includes a fitting portion fittable with the positioning recessed portion or projecting portion when the signal transmission support member lower end portion is connected; a structure in which the antenna main body portion includes a plurality of-mounting support members which are provided integrally on and projected downwardly from the lower surface side of the antenna main body portion and can be mounted onto and fixed to the substrate part, while the respective mounting support members are different in section shapes from each other; and, a structure in which the antenna main body portion includes a plurality of mounting support members which are respectively provided integrally on and projected downwardly from the lower surface side of the antenna main body portion and can be mounted onto and fixed to the substrate part, while the respective mounting support members are arranged asymmetrically with respect to the antenna main body portion. Thanks to this, the antenna main body portion can be easily mounted on the substrate part always in a given direction with respect to the substrate part, and the mounting of the antenna main body portion in the wrong direction can be prevented effectively, which also leads to the improved efficiency of the antenna mounting operation.

What is claimed is:

1. A vehicle antenna comprising:

a rearview mirror of a vehicle; and an antenna built in to said rearview mirror, wherein said rearview mirror comprises a mirror body, a support member for mounting said rearview mirror onto a roof part of the vehicle in vicinity of a windshield of the vehicle, and a box body incorporating therein said built-in antenna, a side surface thereof being covered with said mirror body; and wherein said built-in antenna or a fixing member for fixing said built-in antenna is fixed to said support member inserted into the interior portion of said box body, and said box body is mounted onto said support member in such a manner that said box body can be freely moved in an arbitrary direction and then can be fixed in said direction, whereby, even if said box body is freely moved and the mounting angle of said mirror main body is thereby changed, the mounting angle of said antenna is left unchanged.

2. A vehicle antenna according to claim 1, wherein said support member has a hollow portion therein, and a feeder cable for said built-in antenna is so arranged as to penetrate the interior of said support member.

3. A vehicle antenna according to claim 1, further comprising: an antivibration mechanism provided between said box body and said support member so as to relieve the vibration of said vehicle during the running operation thereof due to the freedom of said box body given by a clearance provided between said support member and an insertion opening formed in said box body for insertion of said support member.

4. A vehicle antenna according to claim 3, wherein said antivibration mechanism is a bellows formed of elastic material, said bellows covering said support member, and one end of said bellows being fixed to a peripheral surface of said support member while the other end thereof being fixed to said box body.

5. A vehicle antenna according to claim 3, wherein said antivibration mechanism is an elastic body interposed between an inner peripheral surface of said insertion opening and a peripheral surface of said support member.

6. A vehicle antenna according to claim 3, wherein said antivibration mechanism is a bagged body containing viscous fluid therein interposed between an inner peripheral surface of said insertion opening and a peripheral surface of said support member.

* * * * *